US008286568B2

(12) United States Patent
Tokura

(10) Patent No.: US 8,286,568 B2
(45) Date of Patent: Oct. 16, 2012

(54) SEWING MACHINE AND COMPUTER-READABLE MEDIUM STORING SEWING MACHINE CONTROL PROGRAM

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 298 days.

(21) Appl. No.: 12/847,540

(22) Filed: Jul. 30, 2010

(65) Prior Publication Data

US 2011/0048300 A1 Mar. 3, 2011

(30) Foreign Application Priority Data

Sep. 3, 2009 (JP) ..... 2009-203648

(51) Int. Cl.
*D05B 21/00* (2006.01)
*D05C 5/06* (2006.01)

(52) U.S. Cl. ..... 112/102.5; 700/137

(58) Field of Classification Search ..... 112/470.01–470.14, 98, 99, 102–103, 112/274–277, 220, 221; 700/136–138
See application file for complete search history.

(56) References Cited

U.S. PATENT DOCUMENTS 4,784,071 A * 11/1988 Sadeh et al. ..... 112/470.07
5,027,726 A * 7/1991 Brower et al. ..... 112/117
5,191,536 A * 3/1993 Komuro et al. ..... 700/138
5,537,945 A 7/1996 Sugihara et al.
5,911,182 A 6/1999 Uyama et al.
5,943,972 A 8/1999 Hirata
6,167,822 B1 1/2001 Miyasako et al.
6,755,141 B2 * 6/2004 Musco et al. ..... 112/475.05
7,290,492 B2 11/2007 Watanabe et al.
7,854,207 B2 12/2010 Kuki et al.
8,061,286 B2 * 11/2011 Hirata et al. ..... 112/470.01
2007/0199492 A1 8/2007 Ishii
2009/0020054 A1 1/2009 Taguchi et al.
2009/0188413 A1 7/2009 Hirata et al.
2009/0188414 A1 7/2009 Tokura (Continued)

FOREIGN PATENT DOCUMENTS

JP U-58-117795 8/1983

(Continued)

OTHER PUBLICATIONS

U.S. Appl. No. 12/659,224, filed Mar. 1, 2010, in the name of Masashi Tokura.

(Continued)

*Primary Examiner* — Ismael Izaguirre
(74) *Attorney, Agent, or Firm* — Oliff & Berridge, PLC

(57) ABSTRACT

A sewing machine that is included in a sewing system includes a transfer device, a sewing device, an image capture device, a communication device, a data computation device, a first control device, a marker data acquisition device, a sewing condition acquisition device, a condition computation device, a correction device, and a sewing control device. The data computation device computes first marker data, and the first control device transmits the first marker data, through the communication device, to another sewing machine. The marker data acquisition device acquires, as second marker data, the first marker data. The sewing condition acquisition device acquires a sewing condition, and the pattern data acquisition device acquires pattern data. The condition computation device computes a correction condition. The correction device corrects the pattern data. The sewing control device performs the sewing in accordance with the corrected pattern data.

8 Claims, 12 Drawing Sheets

U.S. PATENT DOCUMENTS

2011/0048299 A1* 3/2011 Tokura ..... 112/102.5

FOREIGN PATENT DOCUMENTS

| | | |
|---|---|---|
| JP | A-63-177894 | 7/1988 |
| JP | H-5-38703 | 9/1993 |
| JP | A-6-205885 | 7/1994 |
| JP | A-6-339588 | 12/1994 |
| JP | A-7-255968 | 10/1995 |
| JP | A-10-137467 | 5/1998 |
| JP | A-11-99294 | 4/1999 |
| JP | A-11-229262 | 8/1999 |
| JP | A-11-244561 | 9/1999 |
| JP | A-2003-71176 | 3/2003 |
| JP | A-2004-180993 | 7/2004 |
| JP | A-2005-74117 | 3/2005 |
| JP | A-2006-130124 | 5/2006 |
| JP | A-2007-105138 | 4/2007 |
| JP | A-2009-22400 | 2/2009 |
| JP | A-2009-172119 | 8/2009 |
| JP | A-2009-172123 | 8/2009 |
| WO | WO 2009/085005 A1 | 7/2009 |

OTHER PUBLICATIONS

U.S. Appl. No. 12/847,527, filed Jul. 30, 2010, in the name of Masashi Tokura.

U.S. Appl. No. 12/857,147, filed Aug. 16, 2010, in the name of Masashi Tokura.

Japanese Office Action issued in Japanese Patent Application No. 2009-203638 (with translation).

European Search Report issued in European Application No. 10153687.8 on Jul. 15, 2011.

Japanese Office Action issued in Japanese Application No. 2009-203649 on Jul. 26, 2011 (with translation).

* cited by examiner

FIG. 11

| PARAMETER | DATA |
|---|---|
| PATTERN ID | 202 |
| START | 4 |
| END | 6 |
| AMOUNT OF MOVEMENT | $\Delta Mx$, $\Delta My$ |
| ANGLE OF ROTATION | $\phi$ |
| REFERENCE POSITION | (P1, Q1, R1) |
| REFERENCE ANGLE | $\theta$ |

SEWING MACHINE AND COMPUTER-READABLE MEDIUM STORING SEWING MACHINE CONTROL PROGRAM

CROSS-REFERENCE TO RELATED APPLICATION

This application claims priority to Japanese Patent Application No. 2009-203648, filed Sep. 3, 2009, the content of which is hereby incorporated herein by reference in its entirety.

BACKGROUND

The present disclosure relates to a sewing machine that is used in a sewing system that performs sewing of a single embroidery pattern using a plurality of sewing machines and to a computer-readable medium that stores a sewing machine control program.

A sewing system is known in which a plurality of multi-needle sewing machines are connected to one another. The known embroidery sewing system includes a plurality of multi-needle sewing machines and performs sewing of a single embroidery pattern using the plurality of multi-needle sewing machines. More specifically, the embroidery sewing system allocates to each of the multi-needle sewing machines a partial pattern that constitutes a portion of the embroidery pattern, such that the number of times that the thread spools are replaced within the embroidery sewing system is reduced and the sewing time is shortened. Each of the multi-needle sewing machines performs sewing of the partial pattern that has been allocated to it.

SUMMARY

In the known sewing system, cases may occur in which the sewing cannot be performed under the same conditions in every one of the sewing machines included in the sewing system. For example, cases may occur in which the attached positions of embroidery frames in relation to embroidery devices with which the sewing machines are provided differ from one sewing machine to the next, due to attaching errors and the like. In a case where the partial patterns are not sewn under the same conditions in every one of the sewing machines, the possibility arises that the relative positions of the partial patterns that are sewn in the different sewing machines will be unintentionally altered and the appearance of the embroidery pattern will be impaired.

Various exemplary embodiments of the broad principles derived herein provide a sewing machine and a computer-readable medium that stores a sewing machine control program that are capable of matching the positions of partial patterns in a case where a single embroidery pattern is sewn using a plurality of sewing machines.

Exemplary embodiments provide a sewing machine that is included in a sewing system that, using a plurality of the sewing machines, performs sewing of a single embroidery pattern on a work cloth that is held by an embroidery frame. The sewing machine includes a transfer device, a sewing device, an image capture device, a communication device, a data computation device, a first control device, a marker data acquisition device, a sewing condition acquisition device, a pattern data acquisition device, a condition computation device, a correction device, and a sewing control device. The transfer device includes a carriage to which the embroidery frame can be attached and that is adapted to transfer the carriage. The sewing device moves a needle bar, to a bottom end of which a needle is attached, up and down. The image capture device is adapted to capture at least one image of at least one marker that is positioned in a marker area, the marker area being on at least one of the embroidery frame that is attached to the carriage and the work cloth that is held by the embroidery frame. The communication device is adapted to transmit and receive data among the plurality of the sewing machines. The data computation device computes, as first marker data, at least one of a reference position and a reference angle of the at least one marker in relation to the carriage, based on image data that are generated by the image capture device. The first control device transmits the first marker data that are computed by the data computation device, through the communication device, to another sewing machine, among the plurality of the sewing machines, that will be used later than the sewing machine. The marker data acquisition device acquires, as second marker data, through the communication device, the first marker data that are transmitted from another sewing machine among the plurality of the sewing machines. The sewing condition acquisition device acquires a sewing condition that includes a condition for specifying at least one partial pattern among a plurality of partial patterns that form the embroidery pattern as a whole, the at least one partial pattern being allocated to the sewing machine. The pattern data acquisition device acquires pattern data that are data for sewing the at least one partial pattern that is specified by the sewing condition and that is allocated to the sewing machine. The condition computation device computes, as a correction condition, at least one of two differences, the two differences being a difference between a first position and a second position, and a difference between a first angle and a second angle. The first position is the reference position that is included in the first marker data that are computed by the data computation device. The second position is the reference position that is included in the second marker data that are acquired by the marker data acquisition device. The first angle is the reference angle that is included in the first marker data. The second angle is the reference angle that is included in the second marker data. The correction device sets a position and an angle of the at least one partial pattern in relation to the carriage and corrects the pattern data that are acquired by the pattern data acquisition device based on the correction condition that is computed by the condition computation device and on the sewing condition that is acquired by the sewing condition acquisition device. The sewing control device performs the sewing of the at least one partial pattern by controlling the transfer device and the sewing device in accordance with the pattern data that are corrected by the correction device.

Exemplary embodiments also provide a computer-readable medium storing a control program executable on a sewing machine that is included in a sewing system that, using a plurality of the sewing machines, performs sewing of a single embroidery pattern on a work cloth that is held by an embroidery frame. The program includes instructions that cause a controller of the sewing machine to perform the steps of computing, as first marker data, based on image data that are generated by an image capture device that captures at least one image of at least one marker that is positioned in a marker area that is on at least one of the embroidery frame that is removably attached to a carriage and the work cloth that is held by the embroidery frame, in relation to the carriage, at least one of a reference position and a reference angle of the at least one marker, transmitting the computed first marker data, through a communication device that is adapted to transmit and receive data among the plurality of the sewing machines, to another sewing machine, among the plurality of the sewing machines, that will be used later than the sewing machine, acquiring, as second marker data, through the communication device, the first marker data that are transmitted from another sewing machine among the plurality of the sewing machines, acquiring a sewing condition that includes a condition for specifying at least one partial pattern among a plurality of partial patterns that form the embroidery pattern as a whole, the at least one partial pattern being allocated to the sewing machine, acquiring a setting condition that is a condition for specifying a position and an angle of the embroidery pattern in relation to an initial positioning of the embroidery pattern, acquiring pattern data that are data for sewing the at least one partial pattern that is specified by the sewing condition and that is allocated to the sewing machine, computing, as a correction condition, at least one of two differences, the two differences being a difference between a first position and a second position, and a difference between a first angle and a second angle, the first position being the reference position that is included in the computed first marker data, the second position being the position that is included in the second marker data, the first angle being the reference angle that is included in the first marker data, and the second angle being the reference angle that is included in the second marker data, setting a position and an angle of the partial pattern in relation to the carriage, based on the correction condition and the sewing condition, and correcting the pattern data, and performing the sewing of the partial pattern by controlling, in accordance with the corrected pattern data, a transfer device and a sewing device, the transfer device including the carriage and being adapted to transfer the carriage, and the sewing device being adapted to moving a needle bar, to a bottom end of which a needle is attached, up and down.

BRIEF DESCRIPTION OF THE DRAWINGS

Exemplary embodiments will be described below in detail with reference to the accompanying drawings in which:

FIG. 11 is an explanatory figure of history data;

DETAILED DESCRIPTION

Hereinafter, a multi-needle sewing machine (hereinafter simply called the sewing machine) 1 that is an embodiment will be explained with reference to the drawings. The referenced drawings are used for explaining technical features that may be utilized in the present disclosure, and the device configurations and the like that are described are simply explanatory examples that do not limit the present disclosure to only those configurations and the like.

Figure 1:
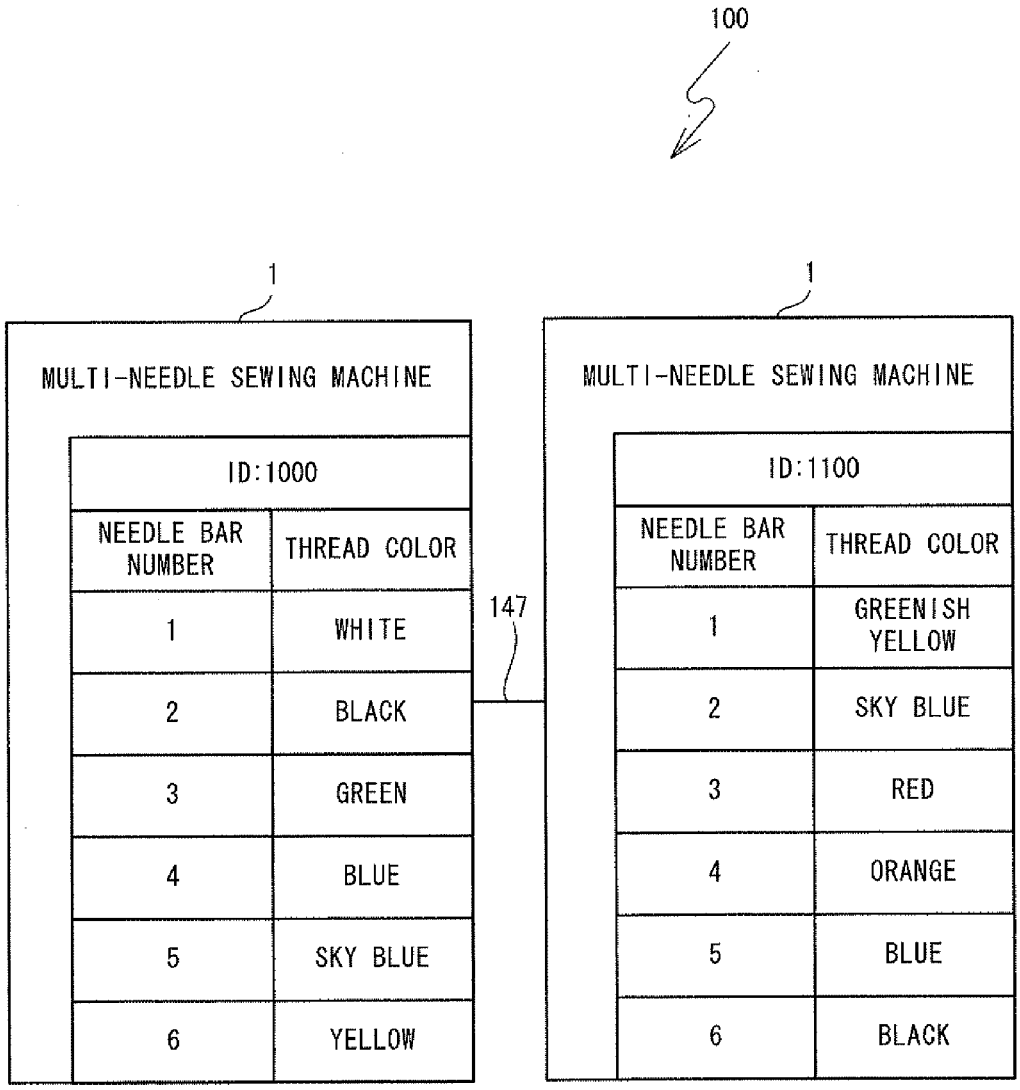
FIG. 1 is a conceptual diagram of a sewing system 100 that is provided with a plurality of multi-needle sewing machines 1.

First, a sewing system 100 will be explained with reference to FIG. 1. The sewing system 100 includes two sewing machines 1. The two sewing machines 1 are connected by a USB cable 147 that is connected to connectors 9 that will be described later (refer to FIGS. 2 and 5). The physical configurations and the electrical configurations are the same between the two sewing machines 1.

Figure 2:
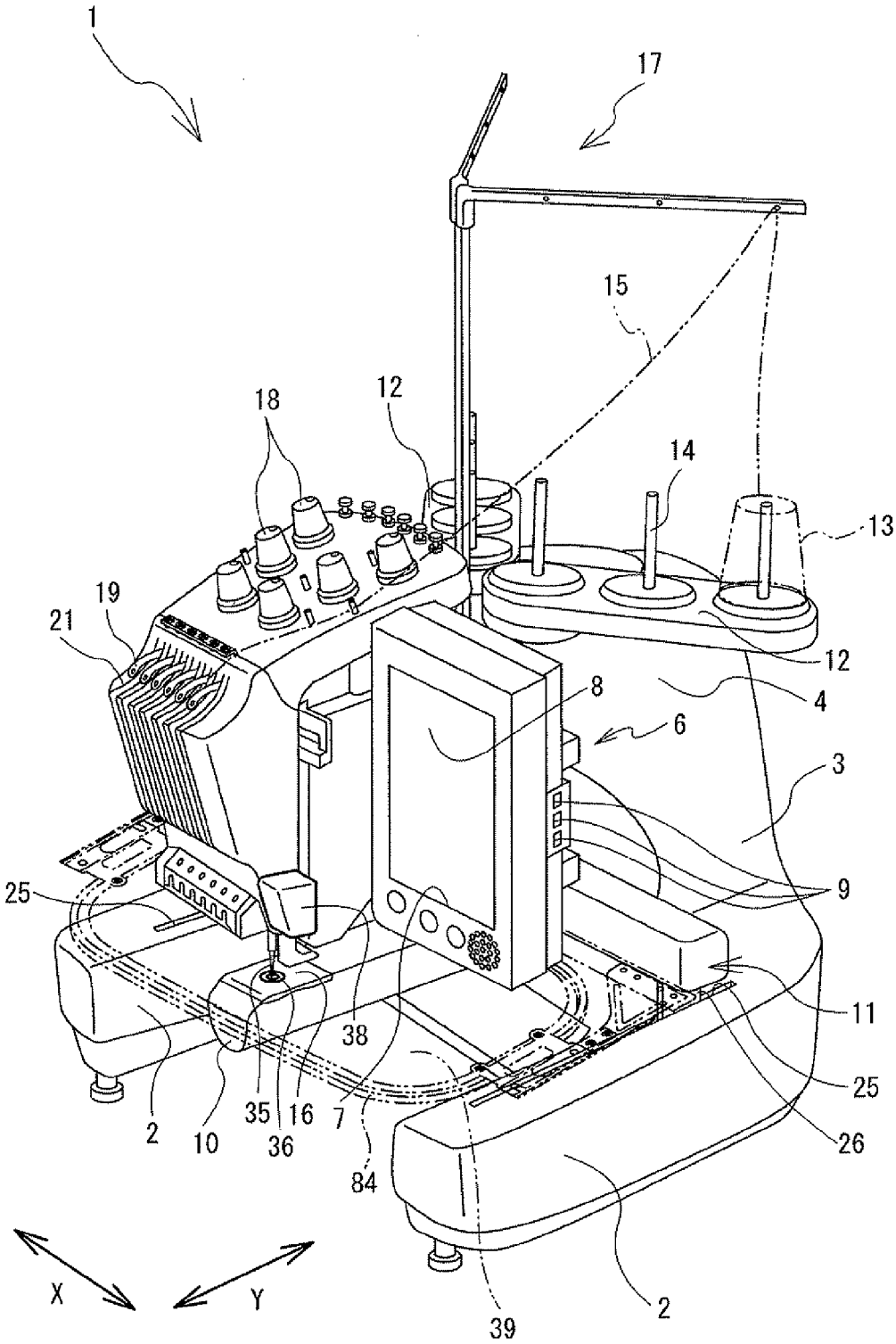
FIG. 2 is an oblique view of the multi-needle sewing machine 1.
Figure 3:
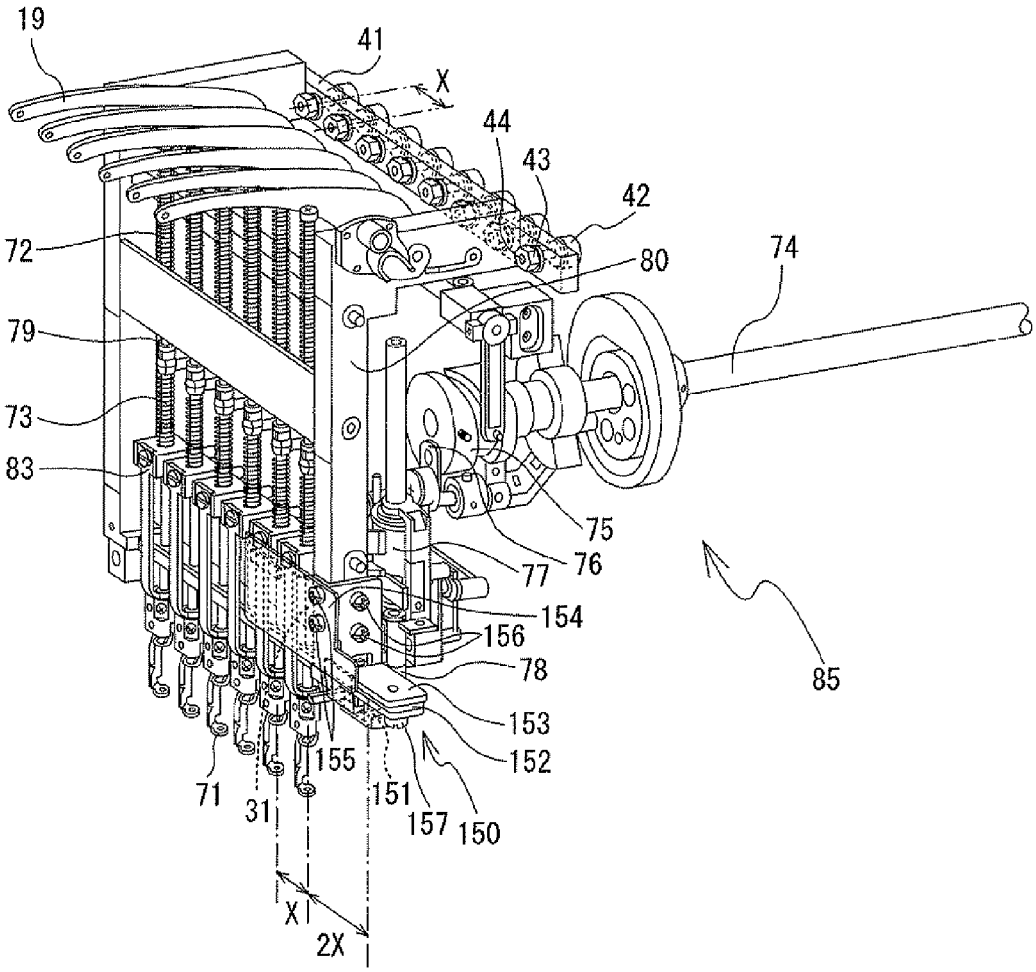
FIG. 3 is an oblique view that shows an interior of a needle bar case 21.

The physical configuration of the sewing machine 1 will be explained with reference to FIGS. 2 and 3. In the explanation that follows, in FIG. 2, the lower left side, the upper right side, the upper left side, and the lower right side of the page respectively indicate the front side, the rear side, the left side, and the right side of the sewing machine 1.

The sewing machine 1 is provided with a supporting portion 2, a pillar 3, and an arm 4. The supporting portion 2 is formed in an inverted U shape in a plan view, and the supporting portion 2 supports the entire sewing machine 1. A pair of left and right guide slots 25 that extend in the front-to-rear direction are provided on the top face of the supporting portion 2. The pillar 3 is provided such that it rises upward from the rear portion of the supporting portion 2. The arm 4 extends forward from the upper end of the pillar 3. A needle bar case 21 is mounted on the front end of the arm 4 such that the needle bar case 21 can move to the left and to the right. The needle bar case 21 will be described in detail later.

An operation portion 6 is provided on the right side of the arm 4 at a central position in the front-to-rear direction. A vertically extending shaft (not shown in the drawings) serves as an axis of rotation on which the operation portion 6 is pivotally supported by the arm 4. The operation portion 6 is provided with a liquid crystal display (hereinafter simply called the LCD) 7, a touch panel 8, and connectors 9. An operation screen for a user to input commands, for example, may be displayed on the LCD 7. The touch panel 8 may be used to accept commands from the user. The user can select various types of conditions relating to a sewing pattern and sewing by using a finger, stylus pen or the like to perform a pressing operation (the operation hereinafter being called a panel operation) on a location on the touch panel 8 that corresponds to a position on a screen that is displayed on the LCD 7 and that shows an input key or the like. The connectors 9 are USB standard connectors, and a USB device 160 (refer to FIG. 5) can be connected to them.

A cylindrical cylinder bed 10 that extends forward from the bottom end of the pillar 3 is provided underneath the arm 4. A shuttle (not shown in the drawings) is provided in the interior of the front end of the cylinder bed 10. A bobbin (not shown in the drawings) on which a lower thread (not shown in the drawings) is wound may be accommodated in the shuttle. A shuttle drive mechanism (not shown in the drawings) is also provided in the interior of the cylinder bed 10. The shuttle drive mechanism rotationally drives the shuttle. A needle plate 16 that is rectangular in a plan view is provided on the top face of the cylinder bed 10. A needle hole 36 through which a needle 35 passes is provided in the needle plate 16.

An embroidery frame moving mechanism 11 is provided underneath the arm 4. The sewing machine 1 performs sewing of an embroidery pattern on a work cloth 39 that is held by an embroidery frame 84 as the embroidery frame 84 is moved to the left and the right, and forward and backward, by an X axis motor 132 (refer to FIG. 5) and a Y axis motor 134 (refer to FIG. 5) of the embroidery frame moving mechanism 11. The embroidery frame moving mechanism 11 will be described in detail later.

A right-left pair of spool platforms 12 are provided at the rear face side of the top face of the arm 4. Three thread spool pins 14 are provided on each of the spool platforms 12. The thread spool pins 14 are pins that extend in the vertical direction. The thread spool pins 14 support thread spools 13. The number of the thread spools 13 that can be placed on the one pair of the spool platforms 12 is six, the same as the number of needle bars 31. Upper threads 15 may be supplied from the thread spools 13 that are attached to the spool platforms 12. Each of the upper threads 15 may be supplied, through a thread guide 17, a tensioner 18, and a thread take-up lever 19, to an eye (not shown in the drawings) of each of the needles 35 that are attached to the bottom ends of the needle bars 31 respectively.

Next, an internal mechanism of the needle bar case 21 will be explained with reference to FIG. 3. As shown in FIG. 3, the six needle bars 31 that extend in the vertical direction are provided inside the needle bar case 21 at equal intervals X in the left-right direction. A needle bar number is assigned to each of the needle bars 31 in order to identify the individual needle bars 31. In the present embodiment, the needle bar numbers 1 to 6 are assigned in order starting from the right side in FIG. 3. The needle bars 31 are supported by two upper and lower securing members (not shown in the drawings) that are secured to a frame 80 of the needle bar case 21, such that the needle bars 31 can slide up and down. A needle bar follow spring 72 is provided on the upper half of each of the needle bars 31, and a presser spring 73 is provided on the lower half of each of the needle bars 31. A needle bar guide 79 is provided between the needle bar follow spring 72 and the presser spring 73, and a presser guide 83 is provided below the presser spring 73. The needle bars 31 are slid up and down by a needle bar drive mechanism 85. The needle bar drive mechanism 85 includes a sewing machine motor 122 (refer to FIG. 5), a thread take-up lever drive cam 75, a coupling member 76, a transmitting member 77, a guide bar 78, and a coupling pin (not shown in the drawings). The sewing machine motor 122 is a drive source for the needle bar drive mechanism 85. The needles 35 (refer to FIG. 2) may be attached to the bottom ends of the needle bars 31. A presser foot 71 that extends from each of the presser guides 83 to slightly below the bottom end portion (the tip portion) of the corresponding needle 35, and operates in conjunction with the up-and-down movement of the corresponding needle bar 31, the presser foot 71 intermittently presses the work cloth 39 (refer to FIG. 2) downward.

An image sensor holding mechanism 150 is attached to the lower portion of the right side face of the frame 80. The image sensor holding mechanism 150 is provided with an image sensor 151, a holder 152, a supporting member 153, and a connecting plate 154. The image sensor 151 is a known complementary metal oxide semiconductor (CMOS) image sensor. The holder 152 supports the image sensor 151 in a state in which a lens (not shown in the drawings) of the image sensor 151 faces downward. The center of the lens of the image sensor 151 is in a position that is at a distance 2× from the needle bar 31 that is the farthest to the right. The supporting member 153 has an L shape when viewed from the front, and the supporting member 153 supports the connecting plate 154 and the holder 152. The supporting member 153 is secured to the lower portion of the right side face of the frame 80 by screws 156. The holder 152 is secured to the bottom face of the supporting member 153 by a screw 157. The connecting plate 154 is a plate that is L-shaped when viewed from the front, and the connecting plate 154 electrically connects the image sensor 151 to a control portion 140 that will be described later (refer to FIG, 5). The connecting plate 154 is secured to the front face of the supporting member 153 by screws 155. The front face, the top face, and the right side face of the image sensor holding mechanism 150 are covered by a cover 38 (refer to FIG. 2).

A plate 41, which extends in the right-to-left direction, is affixed to the rear edge of the upper portion of the frame 80. Eight engaging rollers 42 are respectively mounted on the plate 41 from the rear side by shoulder bolts 44. Each of the engaging rollers 42 has a round cylindrical shape that is not shown in detail in the drawings. The engaging rollers 42 are supported by shoulder bolts 44 such that the engaging rollers 42 may revolve and such that the engaging rollers 42 cannot move in the axial direction of the engaging rollers 42. The shoulder bolts 44 are threaded into threaded holes (not shown in the drawings) in the plate 41 and secured. The tips of the shoulder bolts 44 (the tips of male threaded portions) are secured by nuts 43 such that the shoulder bolts 44 will not be loosened by the revolving of the engaging rollers 42. The intervals between the central axis lines of the engaging rollers 42 are all the same as the intervals X between the needle bars 31. The heights of mounted positions of the eight engaging rollers 42 are all the same. One of the eight engaging rollers 42 engages a helical cam (not shown in the drawings) that is provided in front portion of the arm 4. The helical cam is rotated by a needle bar case motor 45 (refer to FIG. 5) and moves the frame 80 (the needle bar case 21) to the left and to the right. The one of the needle bars 31 with the needle bar numbers 1 to 6 and the image sensor 151 that corresponds to the engaging roller 42 that engages the helical cam is positioned directly above the needle hole 36. However, in a case where the engaging roller 42 that is the second from the right has engaged the helical cam, neither any of the needle bars 31 nor the image sensor 151 is positioned directly above the needle hole 36.

Figure 4:
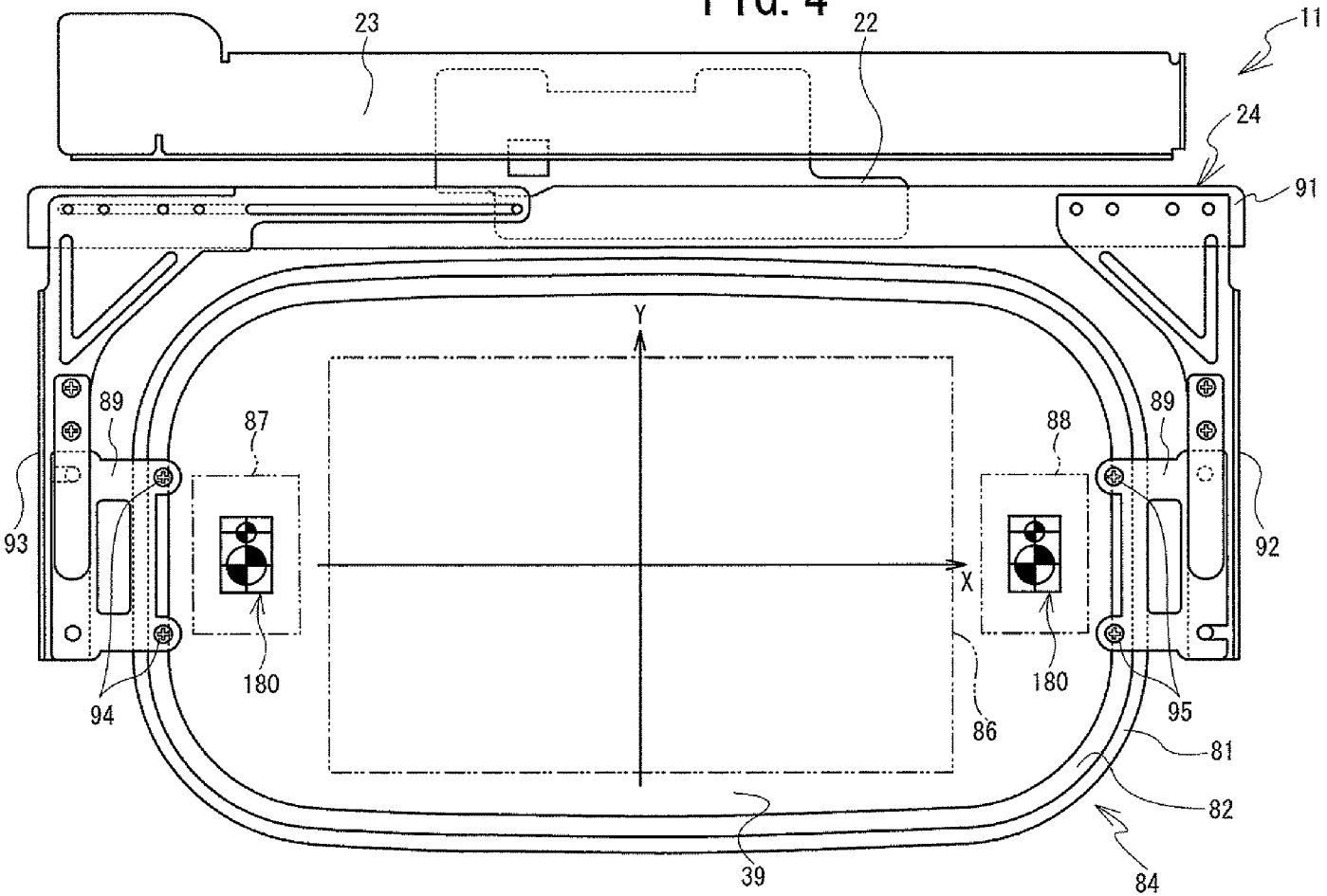
FIG. 4 is a plan view of an embroidery frame moving mechanism 11.

Next, the embroidery frame 84 and the embroidery frame moving mechanism 11 will be explained with reference to FIG. 4. The embroidery frame 84 is provided with an outer frame 81, an inner frame 82, and a pair of left and right coupling portions 89. The embroidery frame 84 holds the work cloth 39 between the outer frame 81 and the inner frame 82. The coupling portions 89 are plate members that, in a plan view, have rectangular shapes in which rectangular center portions have been cut out. One of the coupling portions 89 is secured to the right portion of the inner frame 82 by screws 95, and the other of the coupling portions 89 is secured to the left portion of the inner frame 82 by screws 94. In addition to the embroidery frame 84, a plurality of types of other embroidery frames that differ in both size and shape can also be mounted in the sewing machine 1. Of the embroidery frames that can be used in the sewing machine 1, the embroidery frame 84 is the embroidery frame with the greatest width in the left-right direction (the distance between the left and right coupling portions 89). A sewing area 86 is defined in a position that is inside the inner frame 82, in accordance with the type of the embroidery frame 84.

The embroidery frame moving mechanism 11 includes a holder 24, an X carriage 22, an X axis drive mechanism (not shown in the drawings), a Y carriage 23, and a Y axis drive mechanism (not shown in the drawings). The holder 24 supports the embroidery frame 84 such that the embroidery frame 84 can be mounted and removed. The holder 24 is provided with an attaching portion 91, a right arm portion 92, and a left arm portion 93. The attaching portion 91 is a plate member that is rectangular in a plan view, with its long sides running in the left-right direction. The right arm portion 92 is a plate member that extends in the front-rear direction and is secured to the right end of the attaching portion 91. The left arm portion 93 is a plate member that extends in the front-rear direction. The left arm portion 93 is secured to the left portion of the attaching portion 91 in a position that can be adjusted in the left-right direction in relation to the attaching portion 91. The right arm portion 92 is engaged with one of the coupling portions 89, and the left arm portion 93 is engaged with the other of the coupling portions 89.

The X carriage 22 is a plate member, with its long dimension running in the left-right direction, and a portion of the X carriage 22 projects forward from the front end of the Y carriage 23. The attaching portion 91 of the holder 24 is attached to the X carriage 22. The X axis drive mechanism includes the X axis motor 132 (refer to FIG. 5) and a linear movement mechanism (not shown in the drawings). The X axis motor 132 is a stepping motor. The linear movement mechanism includes a timing pulley (not shown in the drawings) and a timing belt (not shown in the drawings), and the linear movement mechanism moves the X carriage 22 to the left and to the right (in the X axis direction) using the X axis motor 132 as its drive source.

The Y carriage 23 has a box shape, with its long dimension running in the left-right direction. The Y carriage 23 supports the X carriage 22 such that the X carriage 22 can move to the left and to the right. The Y axis drive mechanism includes a pair of left and right moving bodies 26 (refer to FIG. 2), the Y axis motor 134 (refer to FIG. 5), and a linear movement mechanism (not shown in the drawings). The moving bodies 26 are coupled to the bottom portions of the left and right ends of the Y carriage 23 respectively and pass vertically through the guide slots 25 (refer to FIG. 2). The Y axis motor 134 is a stepping motor. The linear movement mechanism includes a timing pulley (not shown in the drawings) and a timing belt (not shown in the drawings), and the linear movement mechanism moves the moving bodies 26 forward and backward (in the Y axis direction) along the guide slots 25 using the Y axis motor 134 as its drive source. In conjunction with these movements, the Y carriage 23, which is coupled to the moving bodies 26, and the X carriage 22, which is supported by the Y carriage 23, move forward and backward (in the Y axis direction).

Next, the operation that forms a stitch on the work cloth 39 that is held by the embroidery frame 84 will be explained with reference to FIGS. 2 to 5. The embroidery frame 84 by which the work cloth 39 is held is supported by the holder 24 of the embroidery frame moving mechanism 11 (refer to FIGS. 2 and 4). First, one of the six needle bars 31 is selected by the moving of the needle bar case 21 in the left-right direction. The embroidery frame 84 is moved to a specified position by the embroidery frame moving mechanism 11. The needle bar drive mechanism 85 is driven when a main shaft 74 is rotated by the sewing machine motor 122. The rotational movement of the main shaft 74 is transmitted to the coupling member 76 through the thread take-up lever drive cam 75, and the transmitting member 77, on which the coupling member 76 is pivotably supported, is driven up and down, being guided by the guide bar 78, which is positioned parallel to the needle bar 31. The up-and-down movement is transmitted to the needle bar 31 through the coupling pin (not shown in the drawings), and the needle bar 31, to which the needle 35 is attached, is driven up and down. Through a link mechanism that is not shown in detail in the drawings, the thread take-up lever 19 is driven up and down by the rotation of the thread take-up lever drive cam 75. Furthermore, the rotation of the main shaft 74 is transmitted to the shuttle drive mechanism (not shown in the drawings), and the shuttle (not shown in the drawings) is rotationally driven. Thus the needle 35, the thread take-up lever 19, and the shuttle are driven in synchronization, and a stitch is formed on the work cloth 39.

Figure 5:
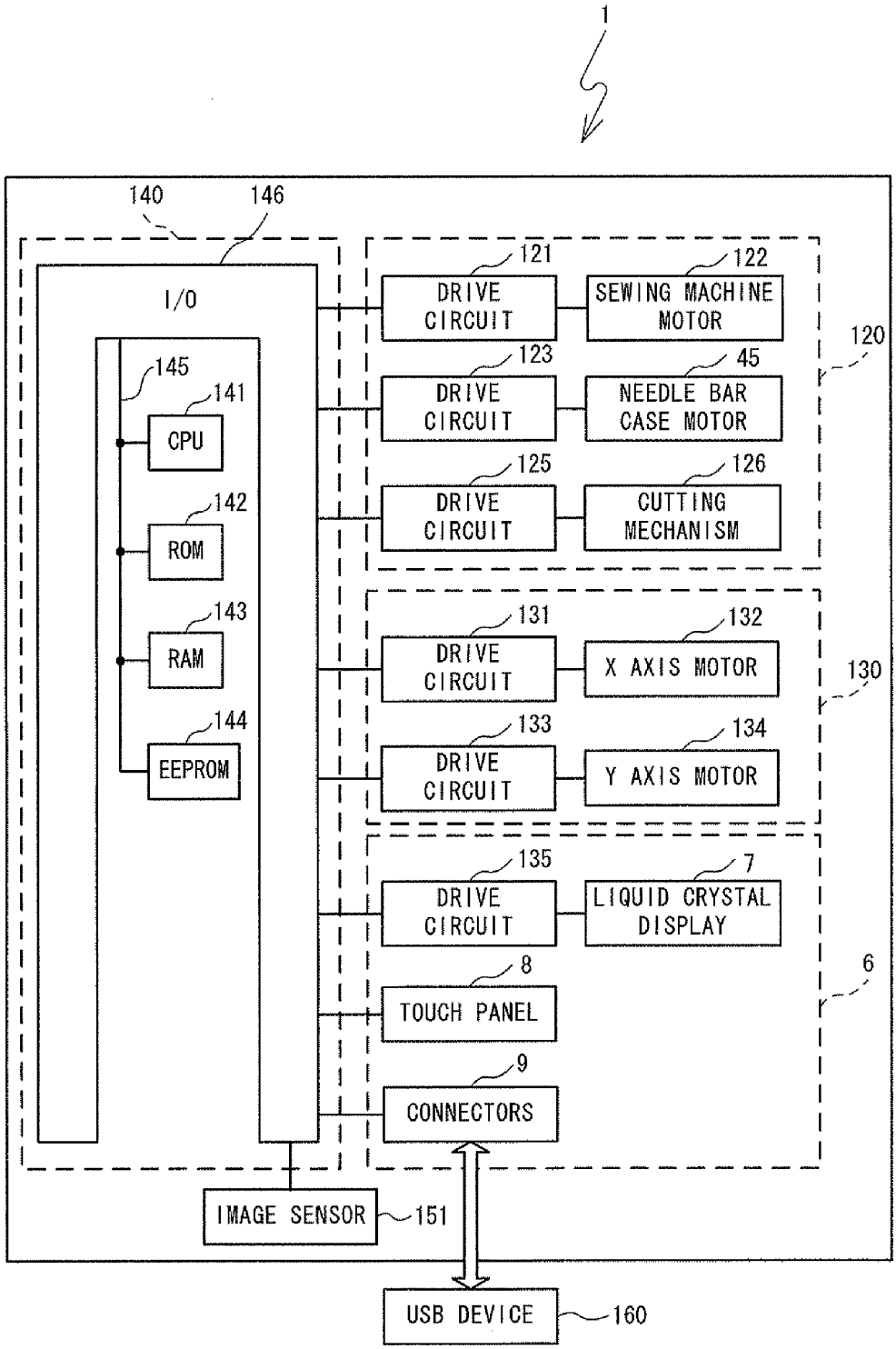
FIG. 5 is a block diagram that shows an electrical configuration of the multi-needle sewing machine 1.

Next, the electrical configuration of the sewing machine 1 will be explained with reference to FIG. 5. As shown in FIG. 5, the sewing machine 1 includes a needle drive portion 120, a sewn object drive portion 130, the operation portion 6, the image sensor 151, and the control portion 140. The needle drive portion 120, the sewn object drive portion 130, the operation portion 6, and the control portion 140 will each be described in detail below.

The needle drive portion 120 includes the sewing machine motor 122, a drive circuit 121, the needle bar case motor 45, a drive circuit 123, a cutting mechanism 126, and a drive circuit 125. The sewing machine motor 122 moves the needle bars 31 reciprocally up and down. The drive circuit 121 drives the sewing machine motor 122 in accordance with a control signal from the control portion 140. The needle bar case motor 45 moves the needle bar case 21 to the left and to the right in relation to the body of the sewing machine 1. The drive circuit 123 drives the needle bar case motor 45 in accordance with a control signal from the control portion 140. The cutting mechanism 126 cuts the upper threads 15 (refer to FIG. 2) that are supplied to the needles 35. The drive circuit 125 drives the cutting mechanism 126 in accordance with a control signal from the control portion 140.

The sewn object drive portion 130 includes the X axis motor 132, a drive circuit 131, the Y axis motor 134, and a drive circuit 133. The X axis motor 132 moves the embroidery frame 84 (refer to FIG. 2) to the left and to the right. The drive circuit 131 drives the X axis motor 132 in accordance with a control signal from the control portion 140. The Y axis motor 134 moves the embroidery frame 84 forward and backward. The drive circuit 133 drives the Y axis motor 134 in accordance with a control signal from the control portion 140.

The operation portion 6 includes the touch panel 8, the connectors 9, a drive circuit 135, and the LCD 7. The drive circuit 135 drives the LCD 7 in accordance with a control signal from the control portion 140. The connectors 9 are provided with functions that connect to the USB device 160. The USB device 160 may be a personal computer, a USB memory, or another sewing machine 1, for example.

The control portion 140 includes a CPU 141, a ROM 142, a RAM 143, an EEPROM 144, and an input/output interface (I/O) 146, all of which are connected to one another by a bus 145. The needle drive portion 120, the sewn object drive portion 130, the operation portion 6, and the image sensor 151 are each connected to the I/O 146. The CPU 141, the ROM 142, the RAM 143, and the EEPROM 144 will be explained in detail below.

The CPU 141 conducts main control over the sewing machine 1 and, in accordance with various types of programs that are stored in a program storage area (not shown in the drawings) in the ROM 142, executes various types of computations and processing that relating to sewing. The programs may also be stored in an external storage device such as a flexible disk or the like.

The ROM 142 is provided with a plurality of storage areas that include the program storage area and a pattern storage area, although these are not shown in the drawings. Various types of programs for operating the sewing machine 1, including a main program, are stored in the program storage area. The main program is a program for executing main processing that will be described later. Embroidery data (pattern data) for sewing embroidery patterns (partial patterns)

are stored in the pattern storage area in association with pattern IDs. The pattern IDs are used in processing that specifies an embroidery pattern.

The RAM 143 is a storage element that can be read from and written to as desired, and storage areas that store computation results and the like from computational processing by the CPU 141 are provided in the RAM 143 as necessary. The EEPROM 144 is a storage element that can be read from and written to as desired, and various types of parameters for the sewing machine 1 to execute various types of processing are stored in the EEPROM 144. IDs for distinguishing the sewing machines 1 that are included in the sewing system 100 are also stored in the EEPROM 144. The IDs can be assigned as desired and may be represented in the form of ten-digit manufacturing numbers, for example. In the present embodiment, the ID of the sewing machine 1 on the left side of FIG. 1 (hereinafter called the first sewing machine 1) is 1000, and the ID of the sewing machine 1 on the right side of FIG. 1 (hereinafter called the second sewing machine 1) is 1100.

Figure 6:
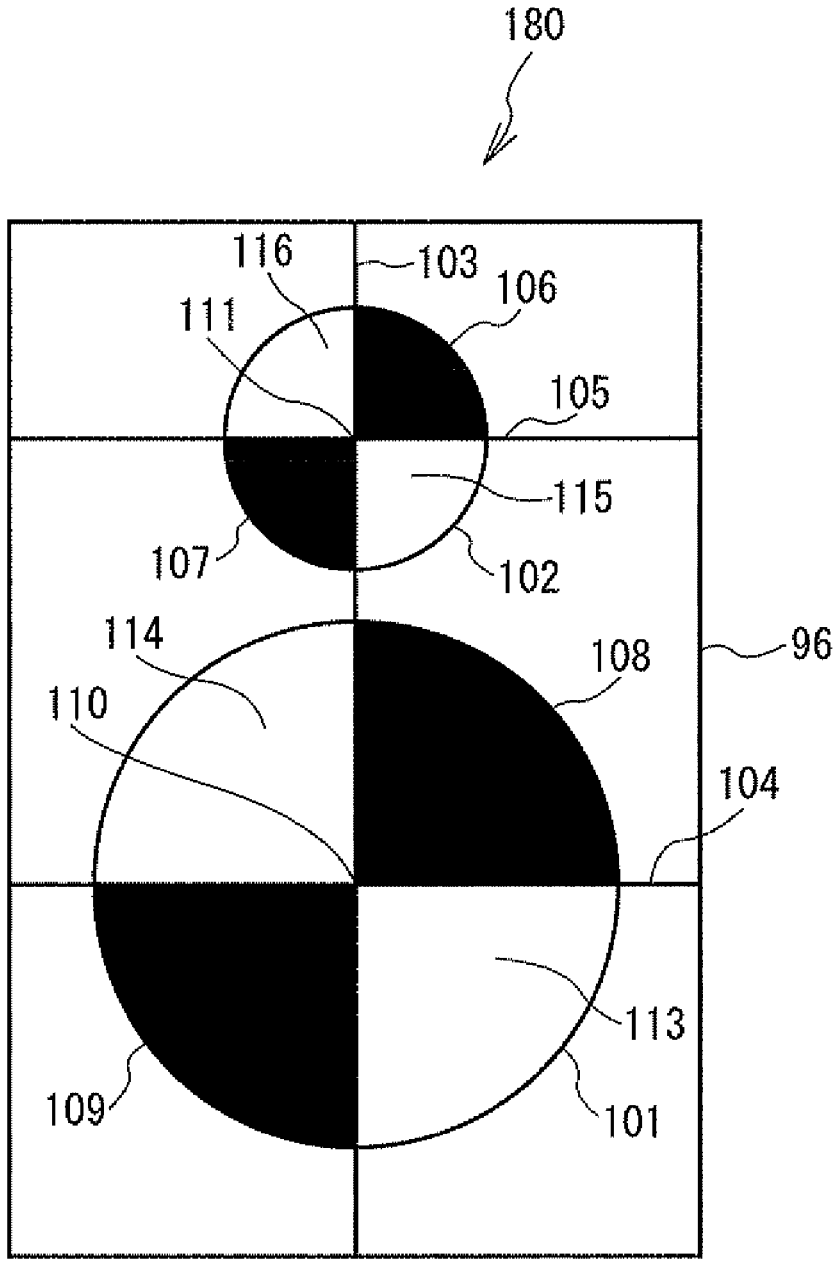
FIG. 6 is an explanatory figure of a marker 180.

Next, a marker 180 will be explained with reference to FIG. 6. The left, right, up, and down directions in FIG. 6 respectively correspond to the left, right, up, and down directions in the marker 180. The marker 180 may be affixed onto the top surface of the work cloth 39. The marker 180 that is shown in FIG. 6 is a thin, transparent base material sheet 96 that is rectangular in shape and measures three centimeters long by two centimeters wide. A pattern is drawn on one surface of the base material sheet 96. Specifically, a first circle 101 and a second circle 102 are drawn on the base material sheet 96. The second circle 102 is disposed above the first circle 101 and has a smaller diameter than does the first circle 101. Line segments 103 to 105 are also drawn on the base material sheet 96. The line segment 103 is a line segment that extends from the top edge to the bottom edge of the marker 180 and passes through a center 110 of the first circle 101 and a center 111 of the second circle 102. The line segment 104 is a line segment that is orthogonal to the line segment 103 and passes through the center 110 of the first circle 101, extending from the right edge to the left edge of the marker 180. The line segment 105 is a line segment that is orthogonal to the line segment 103 and passes through the center 111 of the second circle 102, extending from the right edge to the left edge of the marker 180.

Of the four areas that are bounded by the perimeter of the first circle 101, the line segment 103 and the line segment 104, an upper right area 108 and a lower left area 109 are filled in with black, and a lower right area 113 and an upper left area 114 are filled in with white. Similarly, of the four areas that are bounded by the second circle 102, the line segment 103 and the line segment 105, an upper right area 106 and a lower left area 107 are filled in with black, and a lower right area 115 and an upper left area 116 are filled in with white. All other parts of the surface on which the pattern of the marker 180 is drawn are transparent.

The back surface of the marker 180 (the surface on which the pattern is not drawn) is coated with a transparent adhesive. When the marker 180 is not in use, a release paper (not shown in the drawings) is affixed to the back surface of the marker 180. The user may peel the marker 180 off the release paper and affixes the marker 180 onto a marker area of the work cloth 39. The marker area is a position onto which the marker 180 is affixed. The marker area may be anywhere, as long as the marker area is on at least one of the embroidery frame 84 that is attached to the X carriage 22 and the work cloth 39 that is held by the embroidery frame 84. A predetermined position for the marker area may also be set, and the position may be set anywhere that is on at least one of the embroidery frame 84 that is attached to the X carriage 22 and the work cloth 39 that is held by the embroidery frame 84. In the present embodiment, a marker area 87 and a marker area 88 that are shown in FIG. 4 are set as the marker areas. The marker area 87 is set in a position that is adjacent to the coupling portion 89 on the left side, in an area between the inner frame 82 and the sewing area 86, with its position in the front-to-rear direction being between the two screws 94. The marker area 88 is set in a position that is adjacent to the coupling portion 89 on the right side, in an area between the inner frame 82 and the sewing area 86, with its position in the front-to-rear direction being between the two screws 95.

Figure 7:
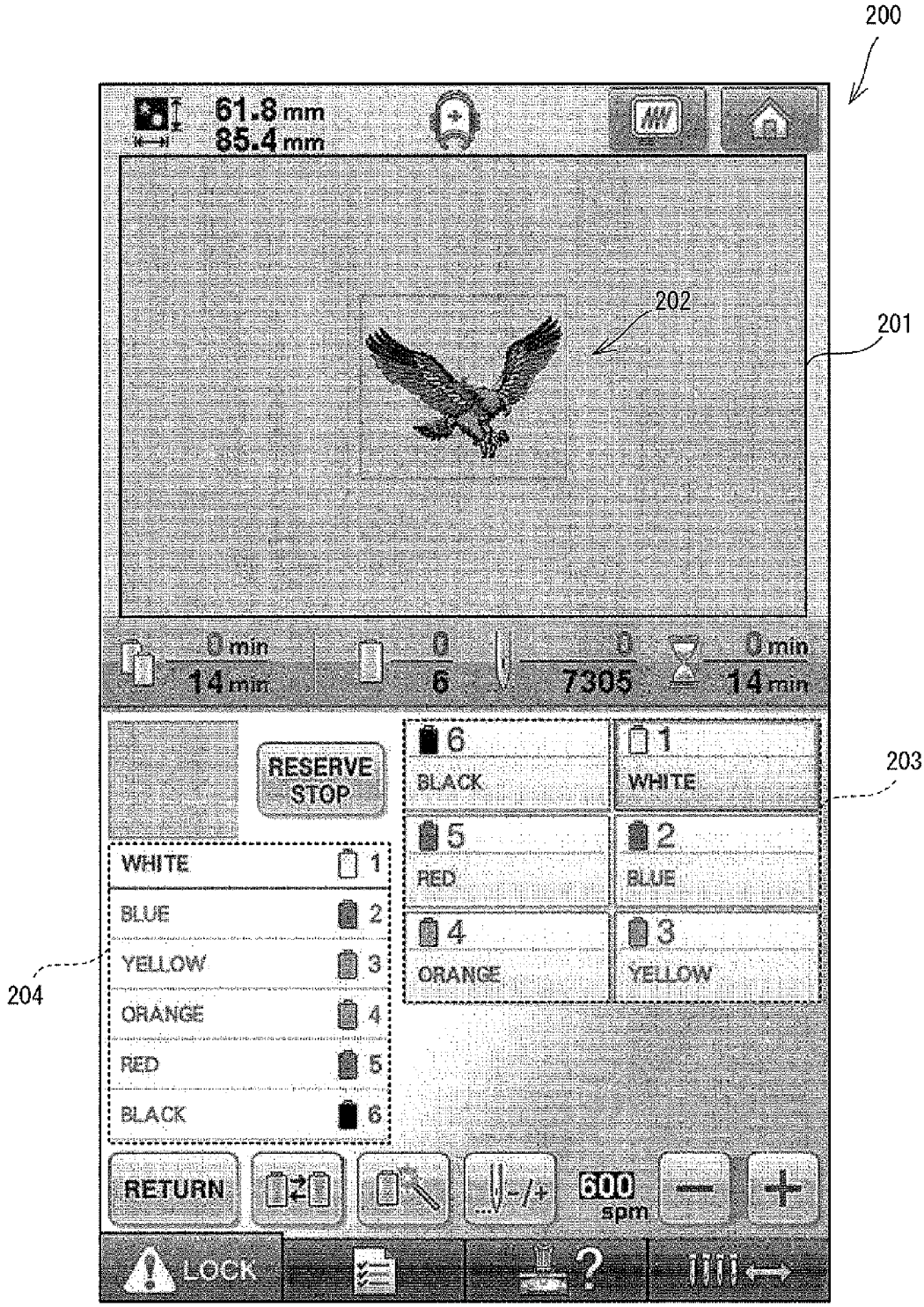
FIG. 7 is an explanatory figure of a sewing screen 200 that is displayed on a liquid crystal display 7.

Next, the main processing that is executed in the sewing machine 1 included in the sewing system 100 will be explained using as an example a case in which an embroidery pattern 202 that is shown in FIG. 7 is sewn. First, the embroidery pattern 202 will be explained with reference to FIG. 7. The embroidery pattern 202 is a pattern of a bird that is to be sewn using threads of six different colors. The embroidery pattern 202 includes partial patterns that are divided according to the thread color, that is, six partial patterns. The embroidery data for the embroidery pattern 202 include six pieces of pattern data. The pattern data are data for sewing the partial patterns. The embroidery pattern 202 is displayed in a pattern display area 201 on a sewing screen 200 that is displayed on the LCD 7. The order in which the partial patterns are sewn is displayed in a sewing order display area 204. As shown in the sewing order display area 204, the partial patterns for the embroidery pattern 202 are supposed to be sewn in the order of white, blue, yellow, orange, red, and black. In a case where the embroidery pattern 202 will be sewn using the one sewing machine 1 that is displaying the sewing screen 200, the colors of threads of the thread spools that should be attached to the sewing machine 1 are displayed in a thread spool display area 203 in association with the numbers of the needle bars 31. The embroidery data (the pattern data) for the embroidery pattern 202 may be stored in one of the ROM 142, the EEPROM 144, and the USB device 160, for example. The embroidery data (the pattern data) may also be acquired through an Internet connection, for example.

Next, the embroidery data (the pattern data) of the present embodiment will be explained. The embroidery data (the pattern data) of the present embodiment include data on coordinates in an embroidery coordinate system. The embroidery coordinate system is the coordinate system for the X axis motor 132 and the Y axis motor 134 that move the X carriage 22. The coordinate data in the embroidery coordinate system describe the position and angle of the embroidery pattern (the partial pattern) in relation to the X carriage 22. In the present embodiment, the embroidery coordinate system is made to correspond to the actual three-dimensional coordinate system (the world coordinate system) in advance. In the embroidery coordinate system, the left-right direction of the sewing machine 1 is an X axis direction, and the front-rear direction of the sewing machine 1 is a Y axis direction. In the present embodiment, in a case where the embroidery frame 84 is properly attached to the X carriage 22, the theoretical center of the sewing area 86 serves as an origin point (X, Y, Z)=(0, 0, 0) at a position that is congruent with a needle drop point. The needle drop point is the point where the needle 35 pierces the work cloth 39 when the corresponding needle bar 31 is moved downward from a state in which the needle 35 that is disposed directly above the needle hole 36 (refer to FIG. 2) is above the work cloth 39. In the present embodiment, the embroidery frame moving mechanism 11 does not move the X carriage 22 in a Z direction (the up-down direction of the sewing machine 1), so as long as the thickness of the work cloth 39 can be ignored, the top surface of the work cloth 39 is deemed to have a Z coordinate value of zero.

Next, an overview of the main processing that is executed in the sewing system 100 will be explained. In the main processing, the partial pattern that is allocated to the sewing machine 1 is sewn in the sewing order. Using the panel operation, the user may select the embroidery pattern, modify the placement of the selected embroidery pattern, and allocate the partial patterns. The user may allocate the partial patterns to the individual sewing machines 1, taking into account the colors of the threads of the thread spools 13 that are attached to the individual sewing machines 1, The main processing may be started in any one of the sewing machines 1 included in the sewing system 100. The sewing machine 1 in which the main processing is started by an instruction from the user transmits a start command to the other sewing machine 1 included in the sewing system 100. When the other sewing machine 1 receives the start command, the other sewing machine 1 starts the main processing. In other words, once the main processing is started in any one of the sewing machines 1, the main processing is executed in all of the sewing machines 1 included in the sewing system 100. As shown in FIG. 1, the colors of the threads of the thread spools 13 that are attached to the first sewing machine 1 are white, black, green, blue, sky blue, and yellow. The colors of the threads of the thread spools 13 that are attached to the second sewing machine 1 are greenish yellow, sky blue, red, orange, blue, and black. In the main processing, the positioning of the embroidery pattern (the partial pattern) is determined in the first sewing machine 1 that will be used, based on a sewing condition. The sewing condition is a condition that includes at least a pattern condition that is a condition for specifying at least one partial pattern, among the plurality of the partial patterns that form the embroidery pattern as a whole, that is allocated to the sewing machine 1. In the present embodiment, the sewing condition includes a setting condition in addition to the pattern condition. The setting condition is a condition for specifying the setting of the positioning of the embroidery pattern. In the present embodiment, the setting condition specifies a position and an angle of the embroidery pattern in relation to an initial positioning of the embroidery pattern. Therefore, in the main processing, the positioning of the embroidery pattern (the partial pattern) is determined in the first sewing machine 1 that will be used, based on the pattern data which are specified by the pattern condition, and on the setting condition. In the sewing machines 1 that will be used second and later, the positioning of the embroidery pattern (the partial pattern) is determined based on the pattern data and the setting condition, as well as correction condition that is computed based on first and second marker data.

Figure 8:
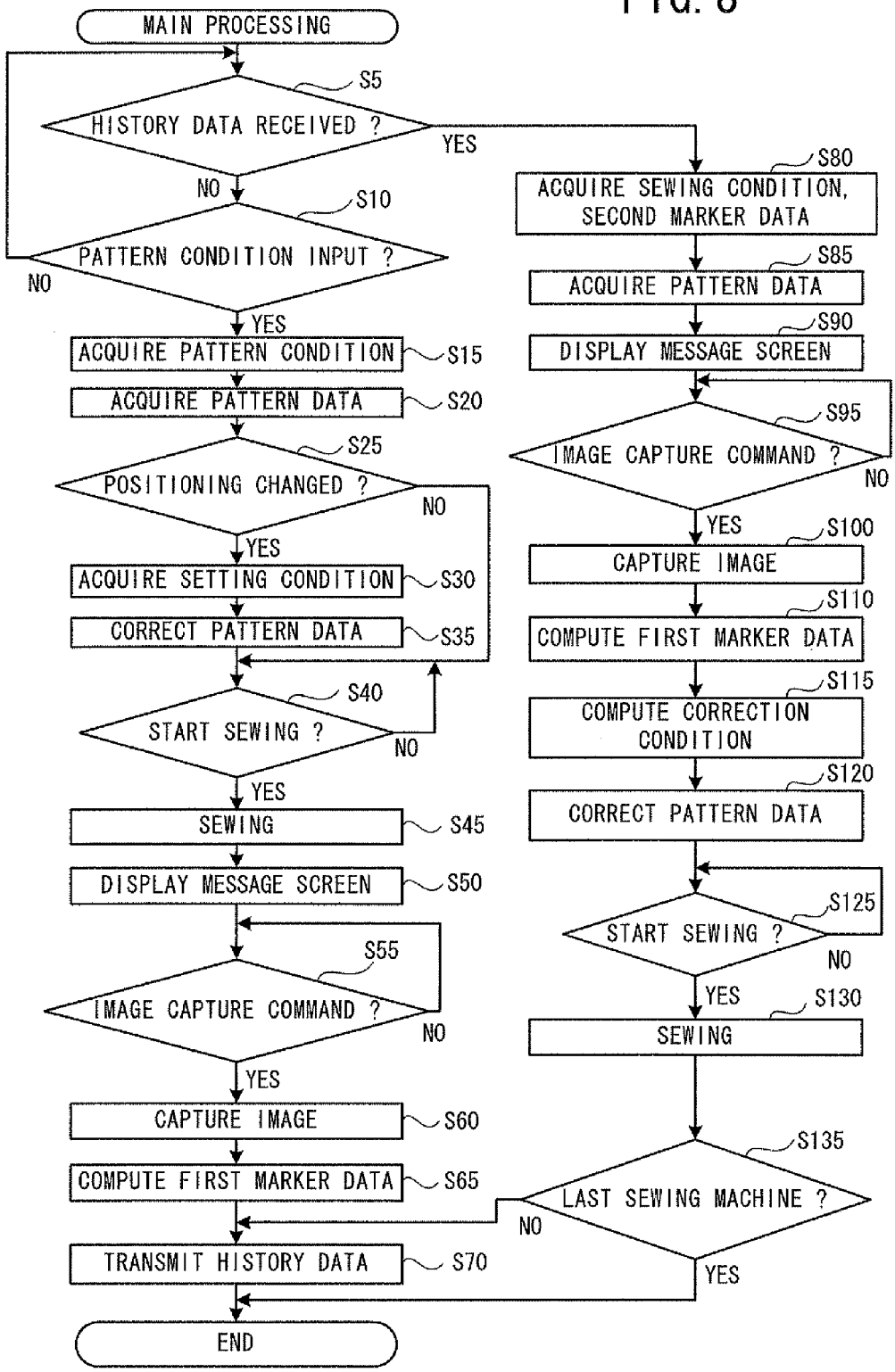
FIG. 8 is a flowchart of main processing.

Next, the main processing in the sewing system 100 will be explained in more detail with reference to FIG. 8. The main processing in FIG. 8 is executed by the CPU 141 in accordance with the main program that is stored in the ROM 142. A case in which the main processing is started in the first sewing machine 1 will be explained as an example.

First, a determination is made as to whether history data have been received (Step S5). The history data are data that are transmitted through the USB cable 147 from the sewing machine 1 that is used before the sewing machine 1 in interest (for example, the first sewing machine 1). The history data will be described in detail later. The processing in a case where the history data have been received (YES at Step S5) will be described later.

In a case where the history data have not been received (NO at Step S5), a determination is made as to whether the pattern condition has been input (Step S10). In the present embodiment, assume information is input on the sewing machine 1 that will be the first to be used in order to specify the partial patterns that are allocated to each of the sewing machines 1 that will be used for sewing the embroidery pattern. Specifically, at Step S10, a condition that includes both the pattern ID that specifies the embroidery pattern and the information that specifies the partial patterns that will be allocated to each of the sewing machines 1 are input as the pattern condition on the sewing machine 1 that will be the first to be used. Therefore, the pattern condition that is input at Step S10 includes a condition for specifying the partial patterns that will be allocated to the sewing machine 1 that will be the first to be used and a condition for specifying the partial patterns that will be allocated to the other sewing machine 1. At Step S10, in a case where both the pattern ID that specifies the embroidery pattern and the information that specifies the partial patterns that will be allocated to each of the sewing machines 1 included in the sewing system 100 have been input by the panel operation, a determination is made that the pattern condition has been input (YES at Step S10). In a case where the pattern condition has not been input (NO at Step S10), the processing returns to Step S5. In the processing at Step S10, assume a specific example in which the pattern ID of the embroidery pattern 202 in FIG. 7 has been input as the pattern ID. In this specific example, it is assumed that the first to the third partial patterns in the sewing order have been allocated to the first sewing machine 1 and that the fourth to the sixth partial patterns in the sewing order have been allocated to the second sewing machine 1. In a case where the pattern condition has been input (YES at Step S10), the pattern condition that has been input is acquired, and the acquired pattern condition is stored in the RAM 143 (Step S15).

Next, the pattern data are acquired from the ROM 142 in accordance with the condition that specifies at least one of the partial patterns that have been allocated to the sewing machine 1 in interest and that is included in the pattern condition that has been acquired at Step S15. The acquired pattern data are stored in the RAM 143 (Step S20). At Step S20, in the case of the specific example that is described above, the pattern data that are acquired in the first sewing machine 1 correspond to the first to the third partial patterns in the sewing order of the embroidery pattern 202. Next, a determination is made as to whether the positioning of the embroidery pattern has been changed (Step S25). A command to change the positioning may be input by the panel operation. In the present embodiment, the sewing machine 1 is capable of changing the settings for the position and the angle of the embroidery pattern, which are expressed in the embroidery coordinate system, in relation to the initial positioning. In a case where the positioning of the embroidery pattern has been changed (YES at Step S25), an amount of movement ($\Delta Mx$, $\Delta My$) of a reference point in relation to the initial positioning and an angle of rotation $\phi$ of the embroidery pattern expressed in the embroidery coordinate system are acquired as a setting condition, and the acquired setting condition is stored in the RAM 143 (Step S30). The initial positioning of the embroidery pattern is defined by the coordinate data in the pattern data that have been acquired at Step S20. The reference point is determined as appropriate, and a hypothetical point that coincides with the origin point prior to the change in the positioning may be used, for example. The angle of rotation $\phi$ expresses, as a positive value, the angle in a case where the embroidery pattern has been rotated counterclockwise around the reference point. At Step S30, assume a specific example in which, after the embroidery pattern 202 has been rotated fifteen degrees counterclockwise around the origin point, the embroidery pattern 202 is moved 25 units in the positive direction of the X axis and 25 units in the positive direction of the Y axis. In this specific example, the amount of movement ($\Delta Mx$, $\Delta My$) of the hypothetical point is acquired as (25, 25), and the angle of rotation $\phi$ is acquired as fifteen degrees.

Next, the pattern data are corrected, and the corrected pattern data are stored in the RAM 143 (Step S35). At Step S35, the pattern data that have been acquired at Step S20 are corrected based on the setting condition that has been acquired at Step S30. The coordinate data that are included in the pattern data are defined as (x, y). The coordinate data (x, y) are corrected based on the setting condition, and coordinate data (x', y') are computed by the correcting processing. In a case where the previously described hypothetical point is defined as the reference point, the coordinate data (x', y') are computed based on the equation $(x', y')=(x \cos \phi - y \sin \phi + \Delta Mx, x \sin \phi + y \cos \phi + \Delta My)$.

In a case where the positioning has not been changed (NO at Step 525), as well as a step following Step S35, a determination is made as to whether a command to start the sewing has been input (Step S40). The command to start the sewing may be input by the panel operation, for example. In a case where the command to start the sewing has not been input (NO at Step S40), the CPU 141 waits until the command to start the sewing is input. In a case where the command to start the sewing has been input (YES at Step S40), the at least one partial pattern is sewn in accordance with the pattern data (Step S45). In a case where, the positioning of the embroidery pattern 202 has not been changed (NO at Step S25), the partial pattern is sewn based on the pattern data that have been acquired at Step S20. In a case where, at Step S25, the positioning of the embroidery pattern 202 has been changed (YES at Step S25), the partial pattern is sewn based on the pattern data that have been corrected at Step S35. Specifically, a control signal is output to the drive circuit 123 in accordance with the pattern data, and the needle bar case motor 45 is driven. This causes the needle 35 to which thread of the thread spool 13 (refer to FIG. 2) is supplied that has the color that corresponds to the pattern data to be positioned directly above the needle hole 36. Control signals are also output to the drive circuit 131 and the drive circuit 133 in accordance with the pattern data, and the embroidery frame 84 is moved. A control signal is also output to the drive circuit 121, and the sewing machine motor 122 is driven. This causes the needle bar 31 that is positioned directly above the needle hole 36 to move in the up and down directions. The processing at Step S45 causes the first to the third partial patterns in the sewing order to be sewn by the first sewing machine 1. The thread spools 13 for the first to the third thread colors in the sewing order (white, blue, yellow) have been attached to the first sewing machine 1. Therefore, at Step S45, the sewing is performed continuously, without interruption, with the threads being switched for the first to the third partial patterns in the sewing order.

Next, a message screen is displayed on the LCD 7 (Step S50). A message is displayed on the message screen that prompts the user to input an image capture command after checking the following item. The item that is displayed on the LCD 7 is whether the markers 180 have been affixed onto the marker area 87 and the marker area 88. The positions of the marker area 87 and the marker area 88 are displayed on the message screen along with a schematic view of the embroidery frame 84 (not shown in the drawings). The user checks the message screen and attached the markers 180 onto the marker area 87 and the marker area 88.

Following the processing at Step S50, the CPU 141 waits for the image capture command to be input (NO at Step S55), and in a case where the image capture command is input (YES at Step S55), the image sensor 151 captures images of the markers 180 that are affixed onto the marker area 87 and the marker area 88, respectively (Step S60). The image capture command may be input by the panel operation, for example. At Step S60, a control signal is output to the drive circuit 123 (refer to FIG. 5), and the needle bar case 21 is moved to the position where the helical cam (not shown in the drawings) engages the engaging roller 42 that is the farthest to the right. The image sensor 151 is positioned directly above the needle hole 36 by the moving of the needle bar case 21. Next, control signals are output to the drive circuit 131 (refer to FIG. 5) and the drive circuit 133 (refer to FIG. 5), and the embroidery frame 84 is moved in accordance with the embroidery coordinate system coordinates of the marker area 87 that are stored in the EEPROM 144. The marker area 87 is moved to a position directly below the image sensor 151 by the moving of the embroidery frame 84. Next, an image of the marker 180 that is positioned in the marker area 87 is captured by the image sensor 151, and the image data that are thus generated are stored in the RAM 143. In the same manner, an image of the marker 180 that is affixed onto the marker area 88 is captured, and the image data that are thus generated are also stored in the RAM 143.

Next, first marker data are computed based on the image data that have been generated at Step S60, and the computed first marker data is stored in the RAM 143 (Step S65). The first marker data are data that represent at least one of the positions and the angles related to the markers 180 in relation to the X carriage 22. In the present embodiment, the position related to the markers 180 that are described by the coordinates of the embroidery coordinate system (hereinafter called the reference position) and the angle related to the markers 180 in relation to the positive direction on the X axis (hereinafter called the reference angle) are computed as the first marker data.

Figure 9:
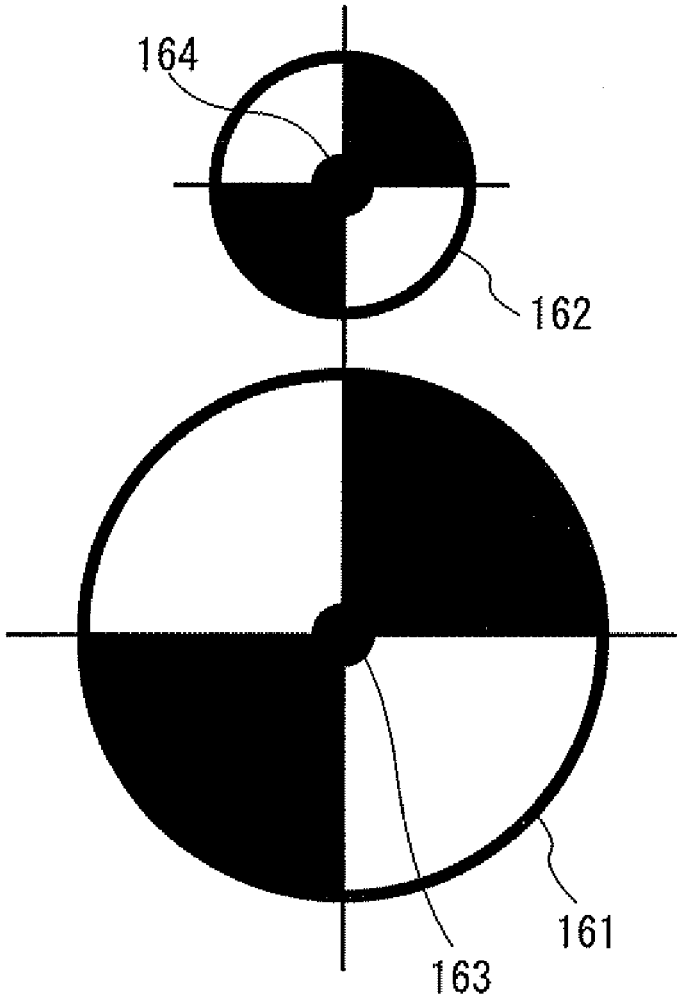
FIG. 9 is an explanatory figure of processing that detects the marker 180 based on image data of the marker 180 that are captured and acquired.

The method for computing the first marker data in the present embodiment will be explained with reference to FIGS. 9 and 10. First, two-dimensional coordinates in an image coordinate system are computed for the first circle 101 and the second circle 102 of the marker 180 (refer to FIG. 6). The image coordinate system is a coordinate system for the image that has been captured by the image sensor 151. The two-dimensional coordinates in the image coordinate system are computed based on a position in the image. Specifically, circumferences of a circle 161 and a circle 162 are identified in the captured image, as shown in FIG. 9, for example, by Hough transform processing, which is a known technique. The coordinates of a center 163 of the circle 161 and a center 164 of the circle 162, and radii of the circle 161 and the circle 162 are computed. At this stage, a circle that is included in a pattern or the like of the work cloth 39 itself may be identified in addition to the first circle 101 and the second circle 102 of the marker 180. Hereinafter, a number z of coordinates that are computed for a center of a circle are indicated as (a, b) (for example, (a1, b1), (a2, b2), (a3, b3), . . . , (az, bz)), and a radius that is computed for a circle is indicated as r (for example, r1, r2, r3, . . . , rz).

Figure 10:
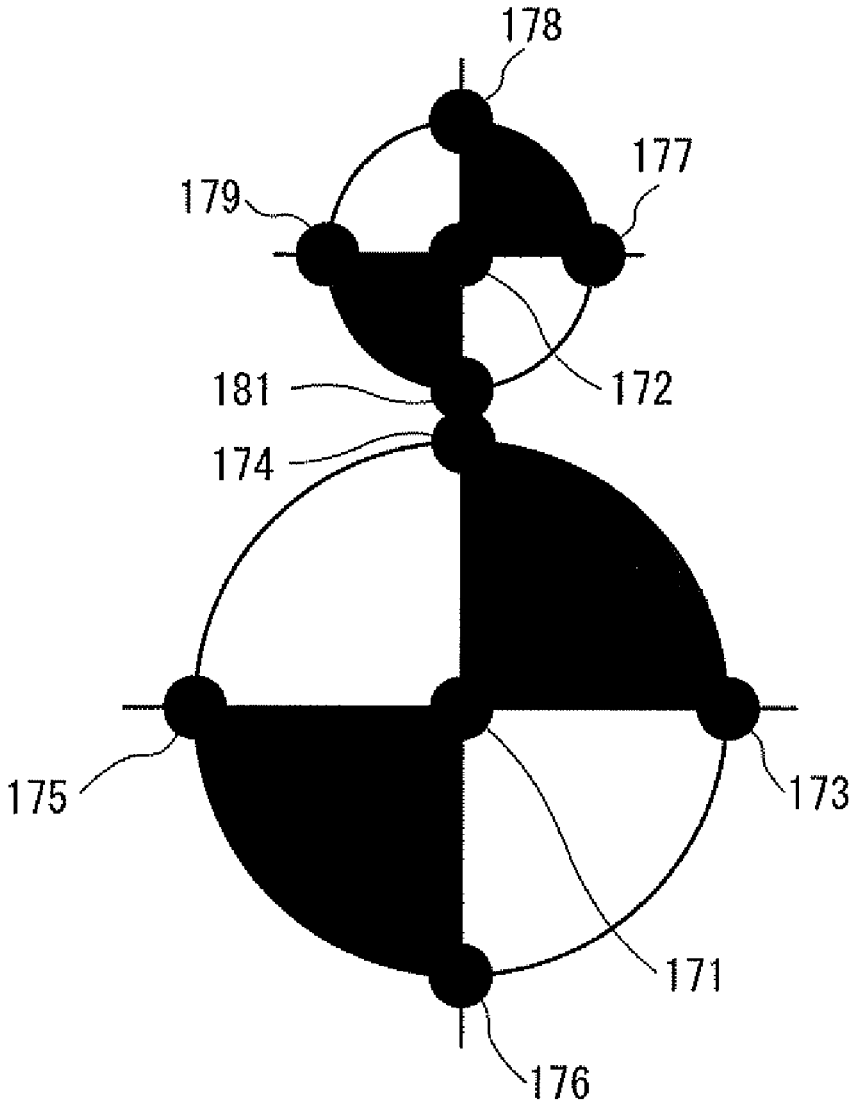
FIG. 10 is an explanatory figure of the processing that detects the marker 180 based on the image data of the marker 180 that are captured and acquired.

The image data are processed, with Harris operator, for example, which is a known technique, to compute coordinates 171 to 179 and 181 of corners, from the captured image, as shown in FIG. 10. The corner refers to an intersection point at which a plurality of edges (portions that are each formed of a line, such as a contour) intersect with each other. Hereinafter, the computed a number 10 of coordinates of the corners are indicated as (s, t) (for example, (s1, t1), (s2, t2), (s3, t3), . . . , (s10, s10)).

Next, the computation results for the coordinates (a, b) and the radii r are compared to the coordinates (s, t). In a case where a set of the coordinates (s, t) exists that coincides with one of the sets of the coordinates (a, b), and sets of the coordinates (s, t) exist that coincide with the coordinates of positions along one of the radii r whose midpoint is at one of the sets of the coordinates (a, b), a determination is made that the first set of the coordinates (s, t) are the coordinates of the center of one of the first circle 101 and the second circle 102 in FIG. 10, and the other sets of the coordinates (s, t) are the coordinates of points where a line segment intersects the circumference of one of the first circle 101 and the second circle 102. Of the coordinates (a, b) that are the coordinates of the center of one of the first circle 101 and the second circle 102, the coordinates that correspond to the center of the circle for which the value of the radius r is greater are identified as the coordinates (p, q) of the center of the first circle 101. The coordinates that correspond to the center of the circle for which the value of the radius r is smaller are identified as the coordinates (u, v) of the center of the second circle 102. The executing of the image processing that is described above causes the coordinates (p1, q1) of the center of the first circle 101 and the coordinates (u1, v1) of the center of the second circle 102 to be computed for the marker 180 that is positioned in the marker area 87. The coordinates (p2, q2) of the center of the first circle 101 and the coordinates (u2, v2) of the center of the second circle 102 in the marker 180 that is positioned in the marker area 88 are computed in the same manner.

Next, three-dimensional coordinate conversion processing is executed on the center coordinates that have been computed. The three-dimensional coordinate conversion processing is processing that converts the two-dimensional coordinates of the image coordinate system into the three-dimensional coordinates of the embroidery coordinate system (the world coordinate system). The three-dimensional coordinate conversion processing may be executed using a known method. For example, Japanese Laid-Open Patent Publication No. 2009-172119 discloses the three-dimensional coordinate conversion processing, the relevant portions of which are herein incorporated by reference. In the three-dimensional coordinate conversion processing, the amount of movement of the embroidery frame 84 at Step S60 is factored into the computation of the three-dimensional coordinates of the embroidery coordinate system. The execution of the three-dimensional coordinate conversion processing causes the coordinates (P1, Q1, R1) of the center of the first circle 101 and the coordinates (U1, V1, W1) of the center of the second circle 102 to be computed for the marker 180 that is positioned in the marker area 87. The coordinates (P2, Q2, R2) of the center of the first circle 101 and the coordinates (U2, V2, W2) of the center of the second circle 102 in the marker 180 that is positioned in the marker area 88 are computed in the same manner.

Next, the reference position and the reference angle are computed. The reference position is defined as the coordinates (P1, Q1, R1) of the center of the first circle 101 in the marker 180 that is positioned in the marker area 87, as expressed in the embroidery coordinate system. The reference angle θ is defined as the angle, in relation to the positive direction on the X axis of the embroidery coordinate system, of a vector from the coordinates (P1, Q1, R1) to the coordinates (P2, Q2, R2) of the center of the first circle 101 in the marker 180 that is positioned in the marker area 88. As described previously, the embroidery coordinate system is the coordinate system that is defined for moving the X carriage 22, so the reference position and the reference angle express the position and the angle related to the markers 180 in relation to the X carriage 22, respectively. The marker 180 that is positioned in the marker area 87 and the marker 180 that is positioned in the marker area 88 are differentiated by taking into consideration the coordinates of the centers of the second circles 102 in relation to the centers of the first circles 101 and the positioning of the markers 180 within the embroidery frame 84. In the present embodiment, the Z coordinate of a point on the work cloth 39 is defined as having a (fixed) value of zero, so the reference angle θ is computed using the equation $\theta=\tan^{-1}((Q2-Q1)/(P2-P1))$.

Following Step S65, the history data are transmitted through the connectors 9 and the USB cable 147 from the sewing machine 1 in interest to the sewing machine 1 that will be used later (Step S70). At Step S70, first, the second sewing machine 1 is specified as the sewing machine 1 that will be used later, based on the pattern condition that has been acquired at Step S15. At Step S70, the history data are generated as shown in FIG. 11, with the history data including the pattern condition that has been acquired at Step S15, the setting condition that has been acquired at Step S30, and the first marker data that have been computed at Step S65. The history data in FIG. 11 include the pattern ID, the START, and the END, as information that specifies the at least one partial pattern that is allocated to the sewing machine 1 that will be received the history data, include the amount of movement (ΔMx, ΔMy) and the angle of rotation ϕ as the setting condition, and include the reference position and the reference angle as the first marker data. In a case where the positioning of the embroidery pattern has not been changed by the processing at Step S25, the values (ΔMx, ΔMy) for the amount of movement of the embroidery pattern are set to (0, 0), and the angle of rotation ϕ is set to zero degrees. The history data are transmitted from the first sewing machine 1 to the second sewing machine 1 through the USB cable 147 that is connected to the connectors 9. Following Step S70, the main processing is terminated.

At Step S5, in a case where the history data have been received through the connectors 9 and the USB cable 147 (YES at Step S5), the received history data are stored in the RAM 143 (Step S80). Hereinafter, assume a case in which the main processing is performed in the second sewing machine 1. In this case, the history data that have been transmitted by the processing at Step S70 in the first sewing machine I are acquired at Step S5. The pattern ID, the START, and the END that are included in the history data are acquired as the pattern condition in the sewing condition. The first marker data that are included in the history data are acquired as the second marker data. The amount of movement (ΔMx, ΔMy) and the angle of rotation ϕ of the embroidery pattern 202 are acquired as the setting condition in the sewing condition. Next, the pattern data are acquired based on the pattern condition in the sewing condition that has been acquired at Step S80, and the acquired pattern data are stored in the RAM 143 (Step S85). At Step S85, the pattern data are acquired for the fourth to the sixth partial patterns in the sewing order of the embroidery pattern 202. Next, the message screen is displayed on the LCD 7 (Step S90). On the message screen, a message is displayed that prompts the user to input the image capture command. Next, the processing at Steps S95 to S110 is performed. The processing at Steps S95 to S110 is the same as the processing at Steps S55 to S65, so an explanation will be omitted.

Next, the correction condition is computed based on the second marker data that have been acquired at Step S80 and on the first marker data that have been computed at Step S110, and the computed correction condition is stored in the RAM 143 (Step S115). The correction condition is a condition for matching the positions of the partial patterns. In the present embodiment, each difference of the reference position and the reference angle related to the markers 180 are computed based on the the first marker data and the second marker data. In the present embodiment, the Z coordinate of a point on the work cloth 39 is defined as having a (fixed) value of zero, so correction of the Z axis component is not performed. If the reference position included in the first marker data (hereinafter called the first position) is defined as (f1, g1, h1), and the reference position in the second marker data (hereinafter called the second position) is defined as (f2, g2, h2), the correction condition for the reference position is the difference between the first position and the second position expressed by the equation $(\Delta mx, \Delta my)=(f2-f1, g2-g1)$. In the same manner, if the reference angle included in the first marker data (hereinafter called the first angle) is defined as $\theta 1$, and the reference angle included in the second marker data (hereinafter called the second angle) is defined as $\theta 2$, the correction condition for the reference angle is the difference between the first angle and the second angle expressed by the equation $\Delta\theta=\theta 2-\theta 1$.

Next, the pattern data that have been acquired at Step S85 are corrected, and the corrected pattern data are stored in the RAM 143 (Step S120). At Step S120, the pattern data that have been acquired at Step S85 are corrected based on the setting condition included in the sewing condition that has been acquired at Step S80 and on the correction condition that has been computed at Step S115. First, the pattern data are corrected in the same manner as at Step S35, based on the setting condition that has been acquired at Step S80. Here, assume that the coordinate data that are included in the pattern data are defined as (x, y). For example, corrected coordinate data (x', y') are computed based on the equation $(x', y')=(x \cos \phi-y \sin \phi+\Delta Mx, x \sin \phi+y \cos \phi+\Delta My)$ that is used in a case where the previously described hypothetical point is defined as the reference point, in the same manner as at Step S35. Next, the coordinate data (x', y') are corrected based on the correction condition that has been computed at Step S115, and coordinate data (x", y") are computed by the correcting processing. The coordinate data (x", y") are computed based on the equation $(x'', y'')=((x'-F2) \cos \Delta\theta-(y'-g2) \sin \Delta\theta+F2+\Delta mx, (x'-f2) \sin \Delta\theta+(y'-g2) \cos \Delta\theta+g2+\theta my)$. In a case where the positioning of the embroidery pattern has not been changed, the coordinate data (x", y") may also be computed using (x, y) instead of (x', y').

Next, the CPU 141 waits until the command to start the sewing is input (NO at Step S125), in a case where the command to start the sewing has been input (YES at Step S125), the fourth to the sixth partial patterns in the sewing order are sewn in accordance with the pattern data that have been corrected at Step S120 (Step S130). The thread spools 13 for the fourth to the sixth thread colors in the sewing order (orange, red, black) have been attached to the second sewing machine 1. Therefore, at Step S130, the sewing is performed continuously, without interruption, with the threads being switched for the fourth to the sixth partial patterns in the sewing order. Next, because the second sewing machine 1 is the last sewing machine 1 that is used (YES at Step S135), the processing at Step S70 is omitted, and the main processing is terminated. In a case where, at Step S135, the sewing machine 1 in interest is not the last sewing machine 1 that is used (NO at Step S135), the processing at Step S70 is performed, and then the main processing is terminated.

In the sewing system 100, the sewing position of the partial pattern in any one of the sewing machines 1 that are used second and later can be set in relation to the X carriage 22 based on the markers 180 that are positioned in the marker area 87 and the marker area 88. In particular, in the present embodiment, the second sewing machine 1 that is used can use the first marker data that is computed in the second sewing machine and the second marker data that is computed in the first sewing machine 1 to detect the difference in the positions where the embroidery frame 84 is attached and the differences in the settings of the embroidery coordinate system. The second sewing machine 1 that is used then corrects the pattern data such that the detected differences are eliminated. Therefore, even in a case where the positions where the embroidery frame 84 is attached are different between in the first sewing machine 1 and in the second sewing machine 1, it is possible to avoid a situation in which the relative positioning of the partial patterns that are sewn in the plurality of the sewing machines 1 is unintentionally changed. Accordingly, each of the sewing machines 1 included in the sewing system 100 can accurately sew the embroidery pattern 202 together with the other sewing machines 1. Because the sewing machine 1 uses the two markers 180 to compute the angle $\theta$ of the markers 180, the sewing machine 1 can compute the reference angle $\theta$ more precisely than in a case where only one marker is used. Therefore, the sewing machine 1, by using the markers 180 that are positioned in the marker area 87 and the marker area 88 as references, can set the position and the angle of the partial pattern in relation to the X carriage 22 more accurately than in a case where only one marker is used in computing the reference angle $\theta$.

The pattern data can be corrected to match the position and the angle of the embroidery pattern that are specified by the setting condition. In the sewing machines 1 that are used second and later, the setting condition is acquired from the history data that are received as Step S5. Therefore, the time and effort that are required for the user to input the setting condition respectively to the individual sewing machines 1 can be eliminated. Furthermore, it is possible to avoid a situation in which the relative positioning of the partial patterns that are sewn in the plurality of the sewing machines 1 is unintentionally changed due to a mistake by the user in inputting the setting condition to the individual sewing machines 1, respectively. The time and effort that are required for the user to input the pattern condition to the individual sewing machines 1 can be eliminated in the same manner, respectively. It is possible to avoid a situation in which an incorrect partial pattern is sewn due to a mistake by the user in inputting the pattern condition to the individual sewing machines 1, respectively. In addition, because the bottom surfaces of the markers 180 are coated with a transparent adhesive, the markers 180 can be used by affixing them onto the work cloth 39. In a case where the markers 180 are no longer needed after the sewing is completed, the user can easily peel the markers 180 off the work cloth 39. The user can also easily change the positions where the markers 180 are affixed onto the work cloth 39.

The sewing system of the present disclosure is not limited to the embodiment that is described above, and various types of modifications may be made within the scope of the present disclosure. For example, the modifications that are described below from (A) to (G) may be made as desired.

(A) The number of the sewing machines 1 that are included in the sewing system 100 is not limited to being two and may be any number that is at least two. The number of the needle bars that are provided in the sewing machine 1 may be one and may also be more than one. The sewing machines 1 included in the sewing system 100 are capable of communicating with one another, the communication devices and the method of connecting them can be modified as desired. For example, a plurality of the sewing machines 1 may communicate wirelessly. In a case where a plurality of the sewing machines 1 are connected by wire, they may be connected by a LAN cable for example, instead of by a USB cable. In the sewing system 100 that is described above, a plurality of the sewing machines 1 are provided that have the same physical configuration and the same electrical configuration, but a plurality of the sewing machines 1 may also be provided that have different physical configurations and different electrical configurations. In that case, it shall be possible to attach the same embroidery frame in the plurality of the sewing machines 1, and the all of the sewing machines 1 shall be capable of sewing in accordance with the same embroidery data.

(B) The configuration of the sewing machine 1 can be modified as desired. For example, the type and the positioning of the image sensor 151 may be modified as desired. The image sensor 151 may also be an image capture element other than a CMOS image sensor, such as a CCD camera or the like, for example. The direction in which the embroidery frame moving mechanism 11 moves the X carriage 22, for example, can also be modified as desired.

(C) The sizes and shapes of the markers, the design of the markers, the number of the markers, and the marker areas can each be set as desired. The design of the markers may be any design that makes it possible to specify the markers based on the image data of the markers that are captured and acquired. For example, the colors with which the upper right area 108, the lower left area 109, and the like of the markers 180 are filled in are not limited to being white and black, and any other combination of colors that provides a clear contrast may also be used. The markers may also be modified according to the color and the pattern of the work cloth 39, for example.

The number of the markers may also be defined as desired, taking into consideration the precision of the positioning of the partial pattern and the time that is required for executing the main processing. In a case where the number of the markers is greater than one, the plurality of the markers may all be of the same type, and they may also be of a plurality of types. The marker area may also be at least one of the embroidery frame 84 that is attached to the X carriage 22 and the work cloth 39 that is held by the embroidery frame 84. The marker areas may also be defined in advance, as in the present embodiment, and may be positioned anywhere on the work cloth 39, for example. In a case where the marker area is defined in advance, the processing that specifies the markers based on the image data is simpler than in a case where the position of the marker area is defined as desired.

Figure 12:
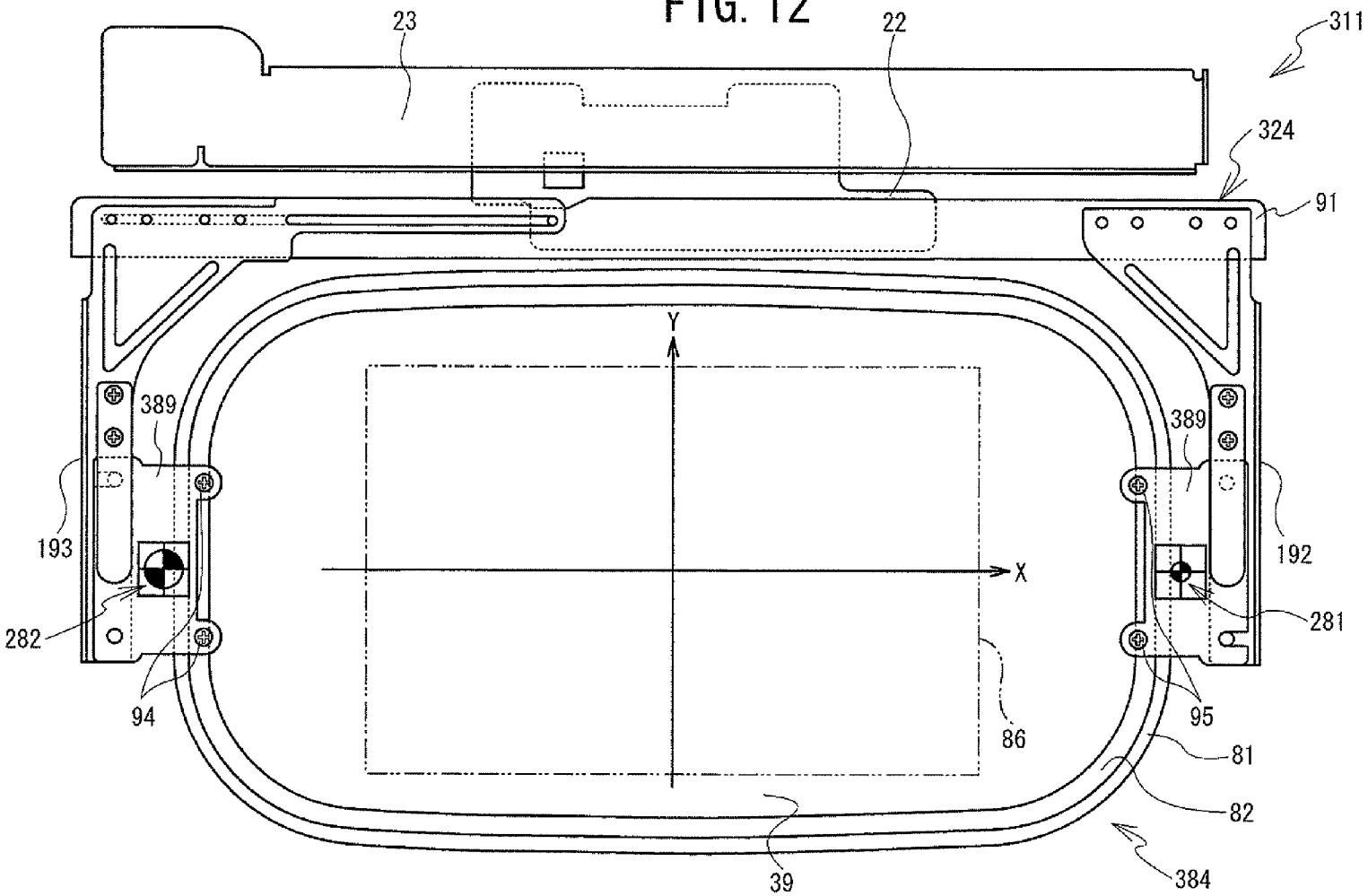
FIG. 12 is a plan view of an embroidery frame moving mechanism 311 in a modified embodiment.

Furthermore, for example, as in a modified embodiment that is shown in FIG. 12, the markers may also be positioned in an embroidery frame 384. In FIG. 12, the same reference numerals are assigned in the same sort of configuration as that of the embroidery frame moving mechanism 11 in FIG. 4. As shown in FIG. 12, a marker 282 on which the first circle 101 is drawn and a marker 281 on which the second circle 102 is drawn may also be used. In this case, the marker 281 and the marker 282 may be distinguished by the sizes of the circles. As in FIG. 12, the marker area may also be set in coupling portions 389 of the embroidery frame 384. In a case where the markers 281, 282 are drawn on the embroidery frame 384, as in FIG. 12, it is possible in the sewing machine 1 for the time and effort that are required for the user to place the markers in the marker areas to be eliminated and to reliably avoid a situation in which the markers are placed in positions that are not in the marker areas.

(D) The method of acquiring the pattern condition can also be modified as desired. For example, Japanese Laid-Open Patent Publication No. 2009-22400 discloses a method for allocating the partial patterns to the individual sewing machines 1 automatically, the relevant portions of which are herein incorporated by reference. In the sewing machines 1 that will be used second and later, the pattern condition is acquired from the history data that are transmitted from the sewing machine 1 that has been used immediately prior to the current sewing machine 1, but the user may also input the pattern condition to the individual sewing machine 1 in which the partial pattern will be sewn, respectively, for example. A pattern condition that is stored in an external storage device such as a memory card or the like, for example, may also be acquired. The content of the pattern condition may also be modified as desired. Furthermore, in a sewing system in which the condition is set such that the partial pattern that is sewn can be sewn without the thread spools being changed, for example, the sewing order numbers of the partial patterns for which the sewing has already been completed (hereinafter called the completed numbers) may be defined in the pattern condition. In that case, the sewing machine 1 that has acquired the completed numbers may set as the at least one partial pattern to be sewn at least one partial pattern whose sewing order number is at least one greater than the highest of the completed numbers and that can be sewn without the thread spools 13 being changed. This makes it possible to eliminate the time and effort that are required for the user to allocate the partial patterns to the individual sewing machines 1 while taking into consideration the colors of the threads of the thread spools 13 that are attached to the sewing machines 1.

(E) The embroidery pattern that is sewn by the sewing system 100 may also be modified in various ways. For example, an aggregation of a plurality of patterns may also serve as a single pattern. Furthermore, for example, the content of the setting condition and the method for acquiring the setting condition may also be modified as desired. For example, in the sewing machines 1 that will be used second and later, the setting condition may also be input by the panel operation. Moreover, in a case where the positioning of the embroidery pattern is not changed in relation to the initial positioning, the position and the angle in relation to the X carriage 22 may also be set based on the initial positioning, for example. In that case, the setting condition does not need to be acquired. A rate of enlargement or reduction of the embroidery pattern may also be set along with the setting condition, for example. In that case, the pattern data may be corrected in accordance with the set rate of enlargement or reduction.

(F) The first and second marker data may also include one of the position and the angle of the marker in relation to the X carriage 22. The method for computing the first marker data, for example, may also be modified as desired, in accordance with the first marker data and the markers. For example, in a case where the angle is computed as a part of the first marker data, based on the image data for one of the markers 180, the angle may also be computed based on the coordinates of the center of the first circle 101 and the coordinates of the center of the second circle 102. As another example, in a case where the position is computed as a part of the first marker data, based on the image data for two of the markers 180, the midpoint of a line segment that connects the centers of the first circles 101 of the two markers 180 may be computed as the position of the marker. For example, in a case where the first marker data are only the position of the marker, the angle of the partial pattern is not corrected according to the correction condition at Step S120. In that case, the angle of the partial pattern is set based on the initial position of the partial pattern that is defined by the coordinate data in the pattern data and on the setting condition that is acquired at Step S80. Similarly, in a case where the first marker data is only the angle of the marker, the position of the partial pattern is set based on the initial position of the partial pattern and on the setting condition.

(G) The content of the history data and the method for transmitting the history data can be modified as desired, provided that the history data are transmitted to the sewing machine 1 that will be used later. For example, history data that include associations between the partial patterns and the IDs of the sewing machines 1 may also be transmitted to all of the sewing machines 1 that are included in the sewing system 100. In that case, the sewing machines 1 that have received the history data may specify the partial patterns that are associated with their own IDs, based on the received history data. In a case where the sewing system 100 includes two sewing machines 1, as it is in the present embodiment, for example, the sewing machine 1 that has performed the sewing may set the other sewing machine 1 as the sewing machine 1 that will be used later. As another example, the sewing machine 1 may also specify the sewing machine 1 that will be used later based on one of the pattern condition that is acquired at Step S15 and the history data that are acquired at Step S5, then transmits the history data to the specified sewing machine 1. As yet another example, the image data that are acquired by capturing of the markers 180 may also be included in the history data instead of the first marker data. In that case, the sewing machine 1 that has received the history data may compute the second marker data based on the received image data.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine that is included in a sewing system that, using a plurality of the sewing machines, performs sewing of a single embroidery pattern on a work cloth that is held by an embroidery frame, the sewing machine comprising:

a transfer device that includes a carriage to which the embroidery frame can be attached and that is adapted to transfer the carriage;

a sewing device that moves a needle bar, to a bottom end of which a needle is attached, up and down;

an image capture device that is adapted to capture at least one image of at least one marker that is positioned in a marker area, the marker area being on at least one of the embroidery frame that is attached to the carriage and the work cloth that is held by the embroidery frame;

a communication device that is adapted to transmit and receive data among the plurality of the sewing machines;

a data computation device that computes, as first marker data, at least one of a reference position and a reference angle of the at least one marker in relation to the carriage, based on image data that are generated by the image capture device;

a first control device that transmits the first marker data that are computed by the data computation device, through the communication device, to another sewing machine, among the plurality of the sewing machines, that will be used later than the sewing machine;

a marker data acquisition device that acquires, as second marker data, through the communication device, the first marker data that are transmitted from another sewing machine among the plurality of the sewing machines;

a sewing condition acquisition device that acquires a sewing condition that includes a condition for specifying at least one partial pattern among a plurality of partial patterns that form the embroidery pattern as a whole, the at least one partial pattern being allocated to the sewing machine;

a pattern data acquisition device that acquires pattern data that are data for sewing the at least one partial pattern that is specified by the sewing condition and that is allocated to the sewing machine;

a condition computation device that computes, as a correction condition, at least one of two differences, the two differences being a difference between a first position and a second position, and a difference between a first angle and a second angle, the first position being the reference position that is included in the first marker data that are computed by the data computation device, the second position being the reference position that is included in the second marker data that are acquired by the marker data acquisition device, the first angle being the reference angle that is included in the first marker data, and the second angle being the reference angle that is included in the second marker data;

a correction device that, based on the correction condition that is computed by the condition computation device and on the sewing condition that is acquired by the sewing condition acquisition device, sets a position and an angle of the at least one partial pattern in relation to the carriage and corrects the pattern data that are acquired by the pattern data acquisition device; and a sewing control device that performs the sewing of the at least one partial pattern by controlling the transfer device and the sewing device in accordance with the pattern data that are corrected by the correction device.

2. The sewing machine according to claim 1, wherein:

a plurality of the markers are positioned in the marker area;

the data computation device computes the reference angle, using the image data that the image capture device has generated for the plurality of the markers; and the condition computation device computes, as at least a portion of the correction condition, the difference between the first angle and the second angle.

3. The sewing machine according to claim 1, wherein:

the sewing condition includes a setting condition that is a condition for specifying settings for a positioning of the embroidery pattern;

the sewing machine further comprises a second control device that transmits the setting condition through the communication device to another sewing machine among the plurality of the sewing machines; and the sewing condition acquisition device acquires, through the communication device, as a portion of the sewing condition, the setting condition that is transmitted from another sewing machine among the plurality of the sewing machines.

4. The sewing machine according to claim 1, further comprising a second control device that transmits, through the communication device to another sewing machine among the plurality of the sewing machines, a condition for specifying the at least one partial pattern that is allocated to the other sewing machine, wherein the sewing condition acquisition device acquires, through the communication device, as at least a portion of the sewing condition, the condition that is transmitted from another sewing machine among the plurality of the sewing machines.

5. A computer-readable medium storing a control program executable on a sewing machine that is included in a sewing system that, using a plurality of the sewing machines, performs sewing of a single embroidery pattern on a work cloth that is held by an embroidery frame, the program comprising instructions that cause a controller of the sewing machine to perform the steps of:

computing, as first marker data, based on image data that are generated by an image capture device that captures at least one image of at least one marker that is positioned in a marker area that is on at least one of the embroidery frame that is removably attached to a carriage and the work cloth that is held by the embroidery frame, in relation to the carriage, at least one of a reference position and a reference angle of the at least one marker;

transmitting the computed first marker data, through a communication device that is adapted to transmit and receive data among the plurality of the sewing machines, to another sewing machine, among the plurality of the sewing machines, that will be used later than the sewing machine;

acquiring, as second marker data, through the communication device, the first marker data that are transmitted from another sewing machine among the plurality of the sewing machines;

acquiring a sewing condition that includes a condition for specifying at least one partial pattern among a plurality of partial patterns that form the embroidery pattern as a whole, the at least one partial pattern being allocated to the sewing machine;

acquiring a setting condition that is a condition for specifying a position and an angle of the embroidery pattern in relation to an initial positioning of the embroidery pattern;

acquiring pattern data that are data for sewing the at least one partial pattern that is specified by the sewing condition and that is allocated to the sewing machine;

computing, as a correction condition, at least one of two differences, the two differences being a difference between a first position and a second position, and a difference between a first angle and a second angle, the first position being the reference position that is included in the computed first marker data, the second position being the position that is included in the second marker data, the first angle being the reference angle that is included in the first marker data, and the second angle being the reference angle that is included in the second marker data;

setting a position and an angle of the partial pattern in relation to the carriage, based on the correction condition and the sewing condition, and correcting the pattern data; and performing the sewing of the partial pattern by controlling, in accordance with the corrected pattern data, a transfer device and a sewing device, the transfer device including the carriage and being adapted to transfer the carriage, and the sewing device being adapted to moving a needle bar, to a bottom end of which a needle is attached, up and down.

6. The computer-readable medium according to claim 5, wherein:

the at least one image is captured of a plurality of the markers that are positioned in the marker area;

the image data that correspond to the captured at least one image are generated, the reference angle is computed based on the generated image data for the plurality of the markers; and the difference between the first angle and the second angle is computed as at least a portion of the correction condition.

7. The computer-readable medium according to claim 5, wherein:

the program further includes an instruction that causes the controller of the sewing machine to perform the step of transmitting a setting condition through the communication device to another sewing machine among the plurality of the sewing machines, the setting condition being a condition for specifying settings for a positioning of the embroidery pattern; and the setting condition that is transmitted from another sewing machine among the plurality of the sewing machines is acquired, through the communication device, as a portion of the sewing condition.

8. The computer-readable medium according to claim 5, wherein:

the program further includes an instruction that causes the controller of the sewing machine to perform the step of transmitting, through the communication device to another sewing machine among the plurality of the sewing machines, a condition for specifying the at least one partial pattern that is allocated to the other sewing machine; and the condition that is transmitted from another sewing machine among the plurality of the sewing machines is acquired, through the communication device, as at least a portion of the sewing condition.

* * * * *